US010814507B2

(12) United States Patent
Yusuf

(10) Patent No.: US 10,814,507 B2
(45) Date of Patent: Oct. 27, 2020

(54) PROFILING APPARATUS FOR STYLING FACIAL HAIR

(71) Applicant: ALEEM & COMPANY INC., Kitchener (CA)

(72) Inventor: Shaffeek Alleem Yusuf, Kitchener (CA)

(73) Assignee: ALEEM & COMPANY INC., Kitchener, Ontario (CA)

( * ) Notice: Subject to any disclaimer, the term of this patent is extended or adjusted under 35 U.S.C. 154(b) by 151 days.

(21) Appl. No.: 15/868,605

(22) Filed: Jan. 11, 2018

(65) Prior Publication Data

US 2018/0133911 A1 May 17, 2018

Related U.S. Application Data

(62) Division of application No. 14/634,406, filed on Feb. 27, 2015, now Pat. No. 10,307,922.

(51) Int. Cl.

| | |
|---|---|
| ***B26B 21/40*** | (2006.01) |
| ***B26B 21/12*** | (2006.01) |
| ***B26B 21/00*** | (2006.01) |
| ***B26B 21/14*** | (2006.01) |

(52) U.S. Cl.

CPC ..... *B26B 21/4043* (2013.01); *B26B 21/00* (2013.01); *B26B 21/12* (2013.01); *B26B 21/14* (2013.01); *B26B 21/4012* (2013.01); *B26B 21/4081* (2013.01)

(58) Field of Classification Search

CPC ..... A47L 13/022; A47L 13/08; B26B 21/00; B26B 21/14; B26B 21/12; B26B 21/4043; B26B 21/4081; B26B 21/4012; B26B 21/4018; B26B 21/4025; B26B 21/4031; B44D 3/164

See application file for complete search history.

(56) References Cited

U.S. PATENT DOCUMENTS

| | | | | | |
|---|---|---|---|---|---|
| 1,589,826 | A * | 6/1926 | Strand | B26B 21/20 | 30/48 |
| 2,517,028 | A * | 8/1950 | Ridner, Sr. | B26B 21/18 | 30/50 |
| 2,937,976 | A * | 5/1960 | Granahan | A61K 8/585 | 30/346.53 |
| 3,161,953 | A * | 12/1964 | Theodorou | B26B 19/20 | 30/202 |
| 3,652,342 | A * | 3/1972 | Fischbein | B05D 7/14 | 148/277 |
| 4,791,724 | A * | 12/1988 | Dumas | B26B 21/18 | 30/48 |
| 5,426,853 | A * | 6/1995 | McNinch | B26B 21/14 | 30/48 |
| 5,933,960 | A * | 8/1999 | Avidor | B26B 19/30 | 30/34.2 |
| 6,557,265 | B2 * | 5/2003 | Coffin | B26B 21/225 | 30/50 |
| 6,754,958 | B2 * | 6/2004 | Haws | B26B 21/446 | 222/399 |

(Continued)

*Primary Examiner* — Jonathan G Riley
(74) *Attorney, Agent, or Firm* — Aird & McBurney LP

(57) ABSTRACT

A razor assembly comprising a first razor head member; a second razor head member; a handle; and wherein the first razor head member and the second razor head member are pivotable about each other.

17 Claims, 22 Drawing Sheets

(56) References Cited

U.S. PATENT DOCUMENTS

| | | | | |
|---|---|---|---|---|
| 8,914,980 | B2 * | 12/2014 | Solomennikov | B26B 21/28 30/48 |
| 9,931,754 | B1 * | 4/2018 | Schmidt | B26B 21/225 |
| 2003/0033717 | A1 * | 2/2003 | Cecil | B26B 21/22 30/50 |
| 2007/0220755 | A1 * | 9/2007 | Dror | B26B 19/28 30/42 |
| 2008/0022530 | A1 * | 1/2008 | Royle | B26B 21/227 30/50 |
| 2011/0283539 | A1 * | 11/2011 | Bryan | B26B 21/24 30/40.2 |
| 2012/0131801 | A1 * | 5/2012 | Gonzales | B26B 19/04 30/202 |
| 2014/0123506 | A1 * | 5/2014 | Gaines | B26B 21/4012 30/526 |
| 2015/0183119 | A1 * | 7/2015 | Contaldi | B26B 21/522 132/200 |
| 2016/0288350 | A1 * | 10/2016 | Contaldi | B26B 21/522 |

* cited by examiner

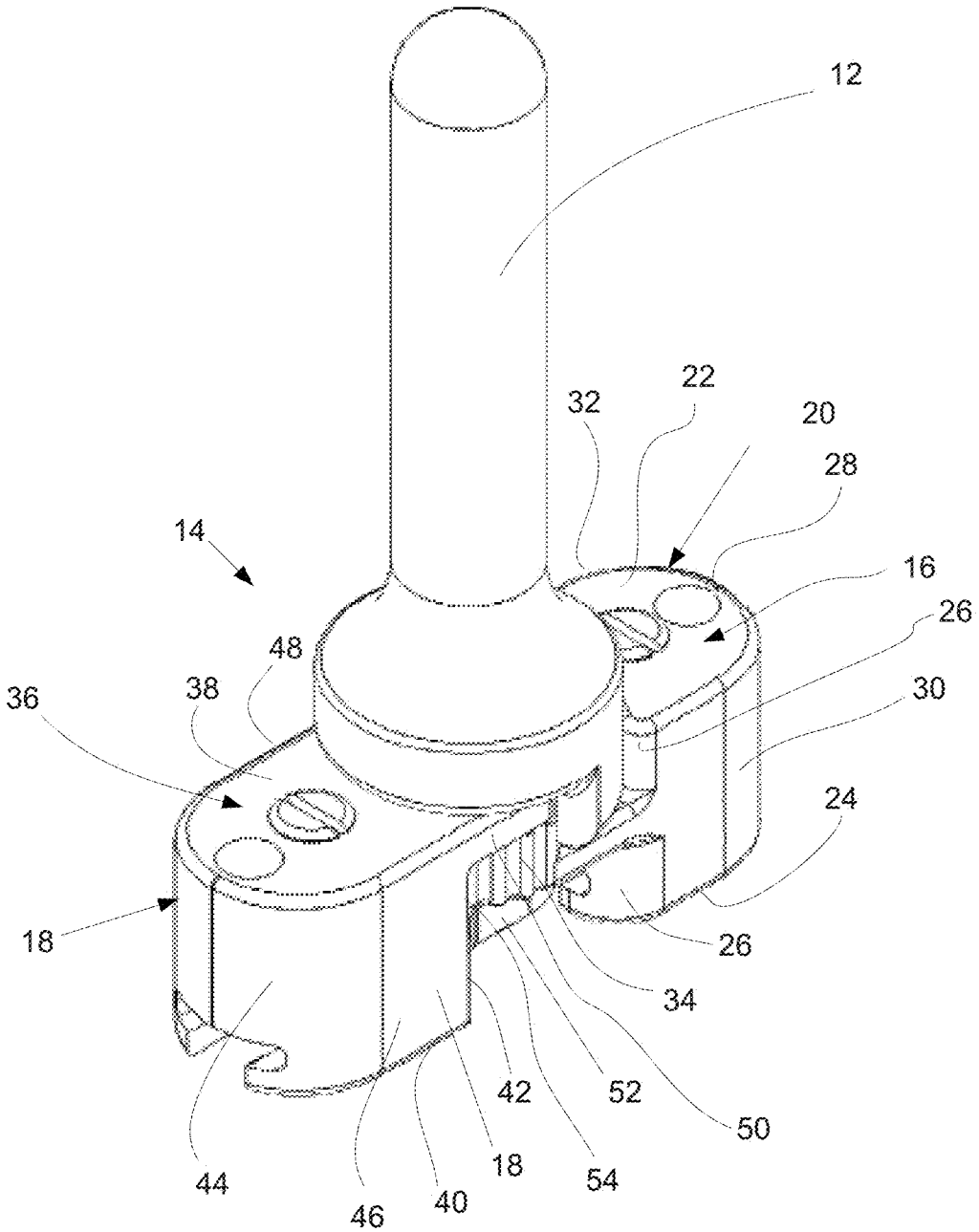
Figure 1 10

200

270

PROFILING APPARATUS FOR STYLING FACIAL HAIR

CROSS-REFERENCE TO RELATED APPLICATIONS

This application is a divisional of U.S. Non-Provisional application Ser. No. 14/634,406 filed on Feb. 27, 2015.

FIELD OF THE INVENTION

The present invention relates to an apparatus for shaving, more particularly it relates to styling facial hair.

DESCRIPTION OF THE RELATED ART

A facial hair style commonly known as "shape-up", "line-up" or "edge-up" is now gaining in popularity, especially with young males. This style involves designing or styling hair such that some of the facial hair or head hair is shaped or lined up with a unique design. As an example, the hair is usually cut around the hairline and can be combined with other hair styles. This styling is normally performed by a barber, due to the precision required, and involves cutting the hair to a deserved minimal height, and employing clippers or a sharp, single razor blade to line up the customer's hair line, while some individuals prefer to groom themselves. Personal grooming through the use of clippers or a sharp, single razor blade to achieve this facial hair style can be particularly challenging due to the diminished visibility of the razor blade relative to the hairline, and therefore can be time consuming. Most trimmers, electric razors, single razor blades or multiple razor blades on the market are designed for shaving the entire face, and are not easily adaptable for effective self-styling of facial hair.

It is an object of the present invention to mitigate or obviate at least one of the above-mentioned disadvantages.

SUMMARY OF THE INVENTION

In one of its aspects, there is provided a razor assembly comprising a first razor head member; a second razor head member; a handle; and wherein said first razor head member and said second razor head member are pivotable about each other.

In another of its aspects, there is provided a razor assembly comprising a handle; and a razor head having a first member and the second razor head member formed together as a unitary part, wherein the first razor head member and a second razor head member are disposed at a fixed angle relative to each other.

In yet another of its aspects, there is provided a razor assembly comprising a handle portion having a frustoconical portion and a ring portion depending therefrom; a blade support removably secured to said ring portion; a blade cartridge having a blade member, whereby said blade cartridge is removably attached to said blade support.

In yet another of its aspects, there is provided a blade cartridge comprising: a body; blade member retained by said body; said body having a pair of resilient arms parallel to said vertical axis and interconnected by a midsection; said arms having a pair of protruding lips facing each other adjacent the extremities of said arms; and whereby said resilient arms are removably coupled to a blade support.

In another of its aspects, there is provided a razor assembly that is suited for styling trimming styles of sideburns, beards, and moustaches, to give a desired appearance.

Advantageously, the razor assembly provides precise shaving in confined, contoured, hard-to-reach areas, crevices, such as chin clefts, and around the edges of sideburns, moustaches and beards. In addition to the precision trimming, the razor assembly is easy to use, easy to control or manipulate, and the desired styles are achievable in a less time-consuming manner. Also, the razor assembly may be easily disassembled for cleaning.

BRIEF DESCRIPTION OF THE DRAWINGS

Several exemplary embodiments of the present invention will now be described, by way of example only, with reference to the appended drawings in which:

FIG. 1 is a perspective view of the razor assembly, in one exemplary embodiment;

DETAILED DESCRIPTION OF EXEMPLARY EMBODIMENTS

Figure 2A:
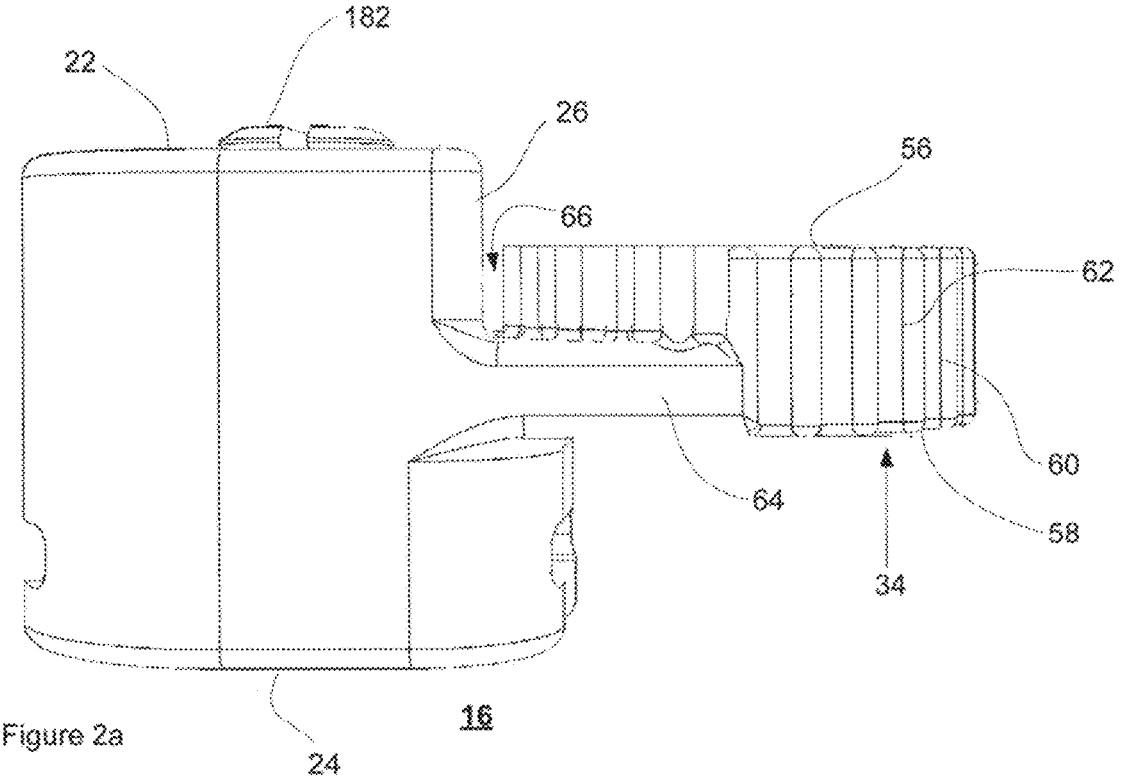
FIG. 2*a* is a perspective view of a first razor head member.

The detailed description of exemplary embodiments of the invention herein makes reference to the accompanying block diagrams and schematic diagrams, which show the exemplary embodiment by way of illustration and its best mode. While these exemplary embodiments are described in sufficient detail to enable those skilled in the art to practice the invention, it should be understood that other embodiments may be realized and that logical and mechanical changes may be made without departing from the spirit and scope of the invention. Thus, the detailed description herein is presented for purposes of illustration only and not of limitation. For example, the steps recited in any of the method or process descriptions may be executed in any order and are not limited to the order presented.

Moreover, it should be appreciated that the particular implementations shown and described herein are illustrative of the invention and its best mode and are not intended to otherwise limit the scope of the present invention in any way. Indeed, for the sake of brevity, certain sub-components of the individual operating components, may not be described in detail herein. Furthermore, the connecting lines shown in the various figures contained herein are intended to represent exemplary functional relationships and/or physical couplings between the various elements. It should be noted that many alternative or additional functional relationships or physical connections may be present in a practical system.

FIG. 1 shows a perspective view of a razor assembly, generally designated by the numeral 10. The razor assembly 10 comprises a handle portion 12 and a razor head 14 with a first razor head member 16 and second razor head member 18. The first razor head member 16 comprises a body 20 which is generally cuboid-shaped with a top surface 22, bottom surface 24, front surface 26, curved back surface 28, opposing side surfaces 30, 32. Protruding outwardly from the front surface 26, about midway between the top surface 22 and the bottom surface 24 is a disc-shaped finger 34. The second razor head member 18 comprises a body 36 which is also generally cuboid-shaped with a top surface 38, bottom surface 40, front surface 42, curved back surface 44, opposing side surfaces 46, 48. Extending from the front surface 42 is a top disc-shaped plate 50 adjacent the top surface 38, and parallel to a bottom disc-shaped plate 52 extending from the front surface 42 adjacent the bottom surface 40, to form a gap 54 therebetween. When assembled, the disc-shaped finger 34 is received within the gap 54 between the top disc-shaped plate 50 and the bottom disc-shaped plate 52, and the handle portion 12 is secured to the first razor head member 16 and second razor head member 18 by a fastening means, as will be described later. The handle portion 12, first razor head member 16 and second razor head member 18 are each of a one-piece moulded plastic construction, but may be fabricated using other suitable materials.

Figure 2B:
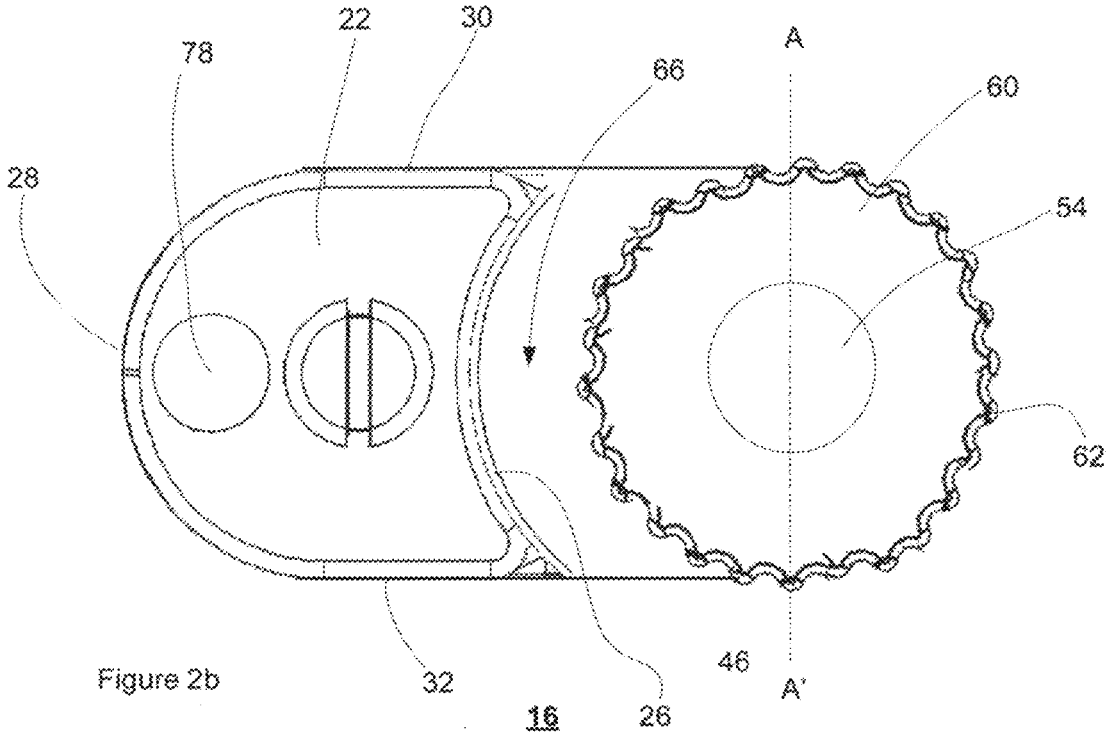
FIG. 2*b* is a top view of the first razor head member.

Looking at FIGS. 2*a* and 2*b*, it can be seen that the disc-shaped finger 34 of the first razor head member 16 comprises a central bore 54 extending therethrough between opposing top and bottom disc surfaces 56, 58, respectively. The disc-shaped finger 34 comprises a geared ring 60 integrally formed with the disc-shaped finger 34. The geared ring 60 includes radially protruding teeth 62 formed thereon, with a gear-less finger portion 64 extending from the bottom surface 58 to about midway of the geared ring 60, and extending from a center axis A-A' of the central bore 54 to the front surface 26. An arcuate recess 66 is formed between a portion of the geared ring 60 above the gear-less finger portion 64 and the front surface 26.

Figure 2C:
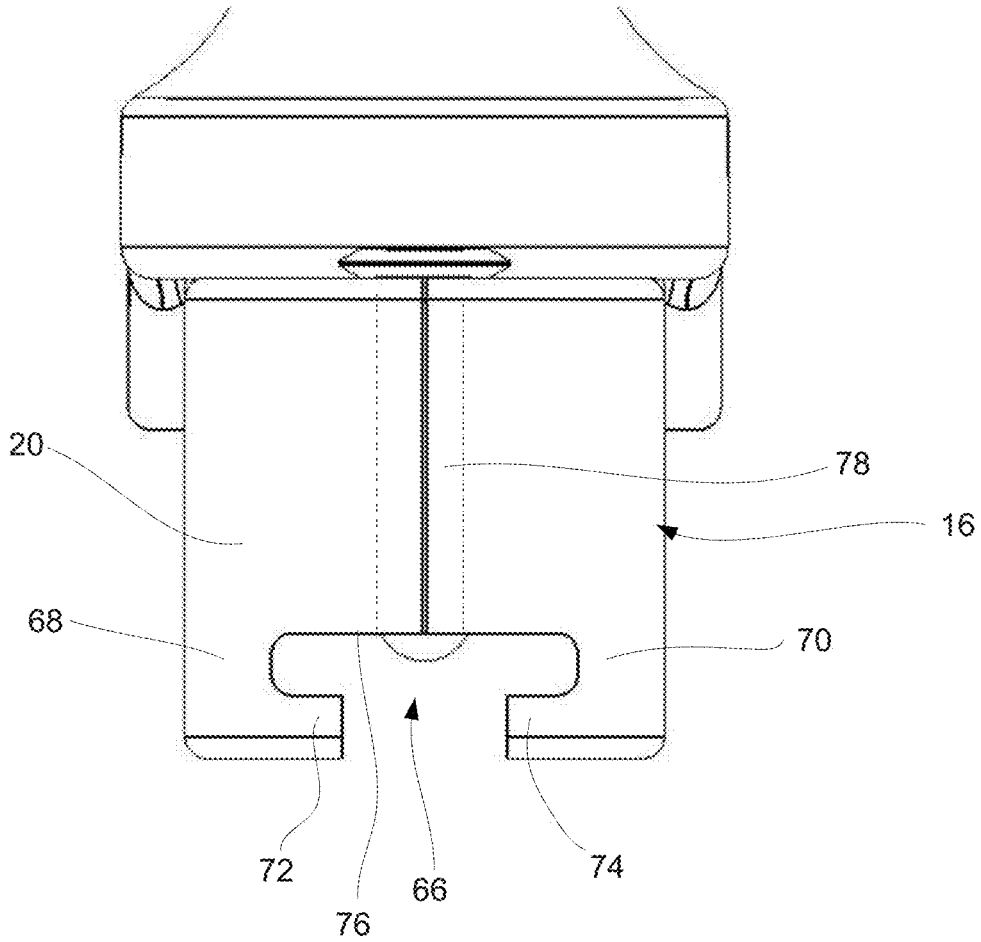
FIG. 2*c* is a side view of a first razor head member.

Referring now primarily to FIG. 2*c*, showing a side view of the first razor head member 16, the body 20 includes a T-shaped channel 66 adjacent the bottom surface 24, and extending between the front surface 26 and the back curved surface 28. Accordingly, the T-shaped channel 66 is formed between legs 68 and 70 with opposing feet 72, 74, and a top wall 76 connecting the legs 68, 70. A body bore 78 extends from the top surface 22 to the top wall 76.

Now looking at FIGS. 3*a*, 3*b*, 3*c* and 3*d*, the bottom disc-shaped plate 52 of the second razor head member 18 comprises parallel edges 80, 82 depending from the front surface 42 and linked together by a rounded edge 84. Formed within the bottom disc-shaped plate 52 is a central bore 86 extending between a top surface 88 and bottom surface 90.

Figure 3A:
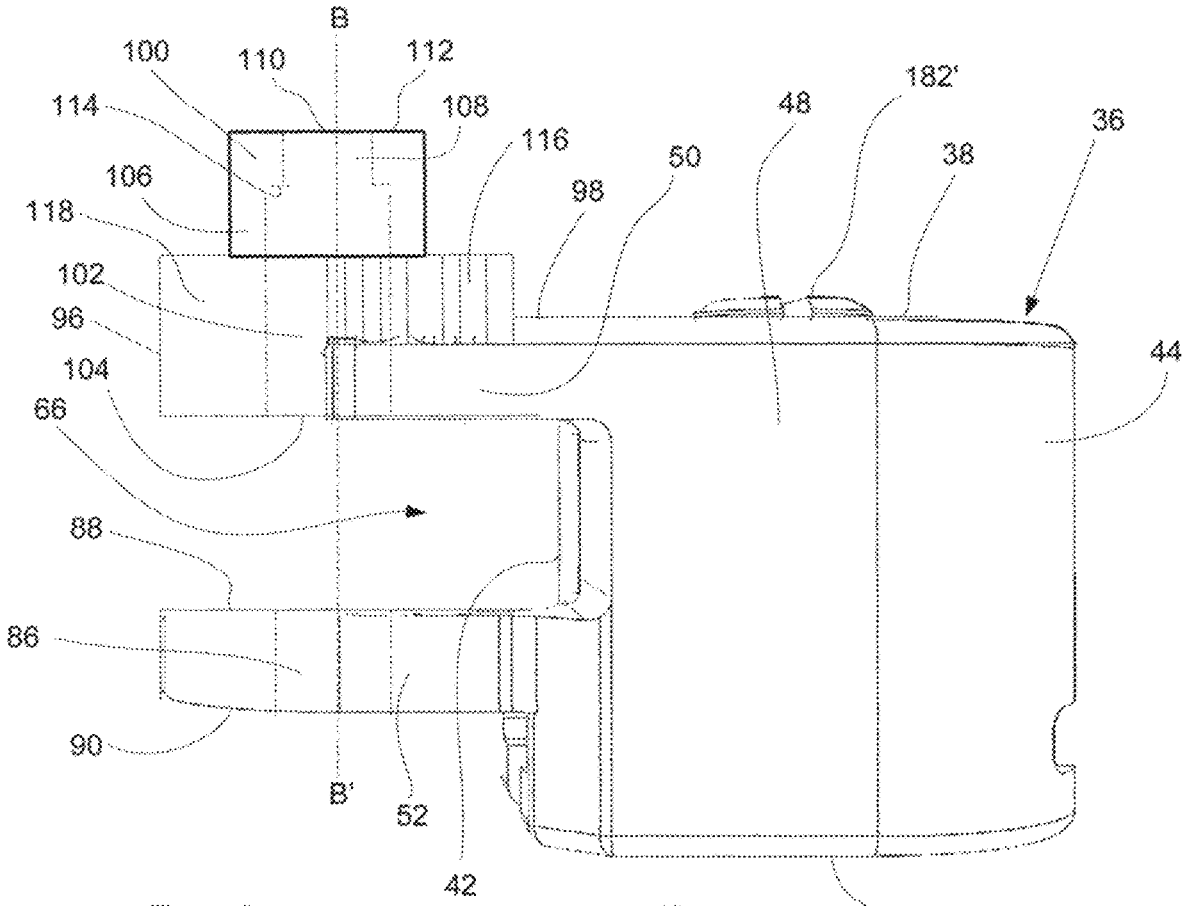
FIG. 3*a* is a perspective view of a second razor head member.
Figure 3B:
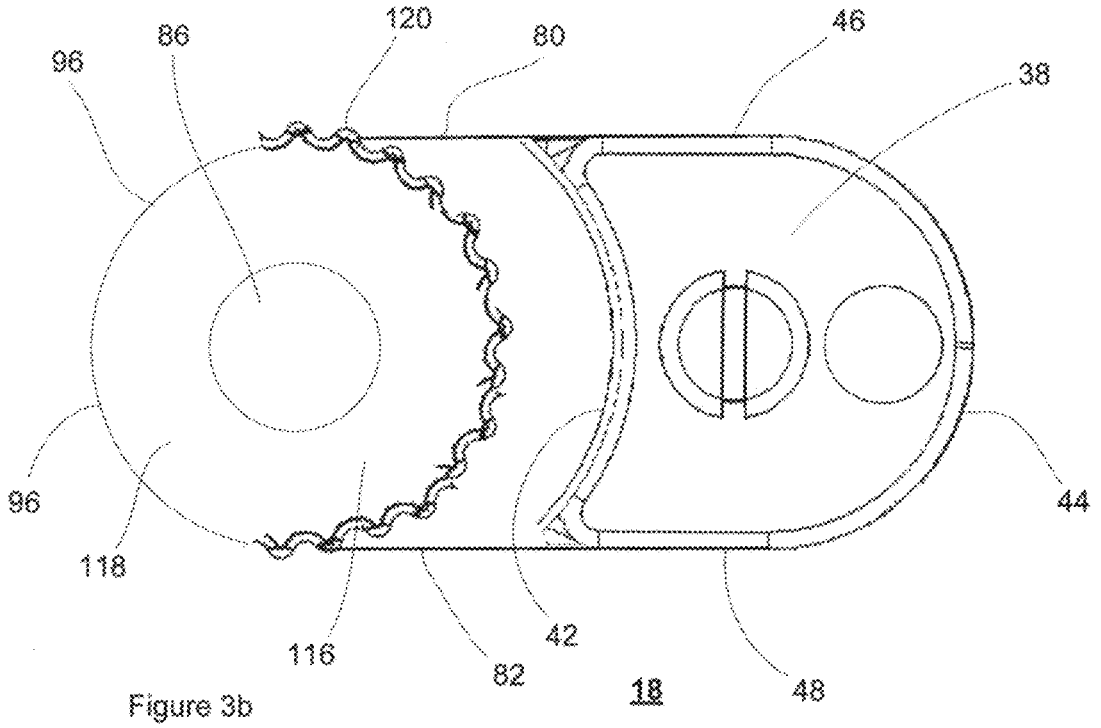
FIG. 3*b* is a top view of the second razor head member.

With particular reference to FIG. 3*a*, the top disc-shaped plate 50 comprises parallel edges 92, 94 depending from the front surface 42, and linked together by a rounded edge 96. The top disc-shaped plate 50 includes a top surface 98 contiguous with the top surface 38 on body 36, with a nipple 100 formed on the top surface 98. A central bore 102 extends from a bottom surface 104 of the top disc-shaped plate 50, through the top disc-shaped plate 50 and a bottom portion 106 of the nipple 100. The central bore 102 within the bottom portion 106 of the annular ring is in communication with a reduced-diameter bore 108 with an opening 110 at a top surface 112 of the nipple 100, such that an annular shoulder 114 is defined between the central bore 102 and the reduced diameter bore 108. A semi-circular geared portion 116 and a semi-circular non-geared portion 118 is formed with the top disc-shaped plate 50. The semi-circular geared portion 116 with outwardly extending gear teeth 120 is formed between the parallel edges 92, 94 and from a center axis B-B' of the bores 102, 108. The semi-circular non-geared portion 118 extends from the center axis B-B' to the rounded edge 96.

Figure 3C:
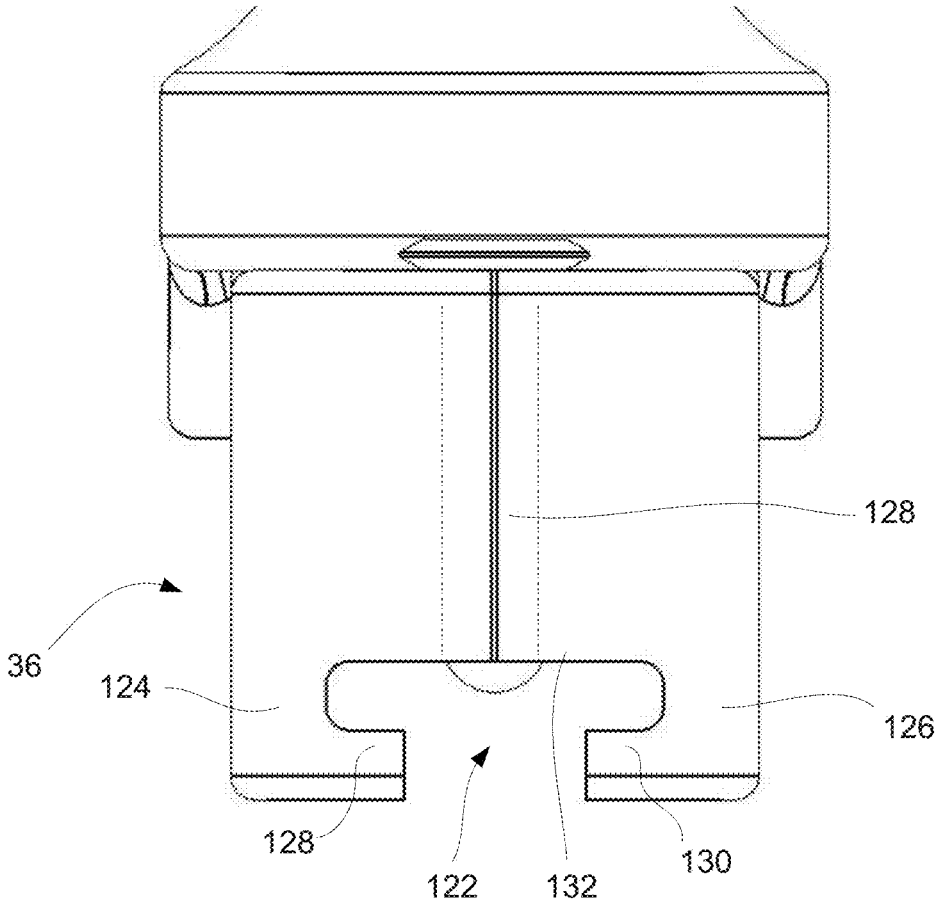
FIG. 3*c* is a side view of a second razor head member.
Figure 3D:
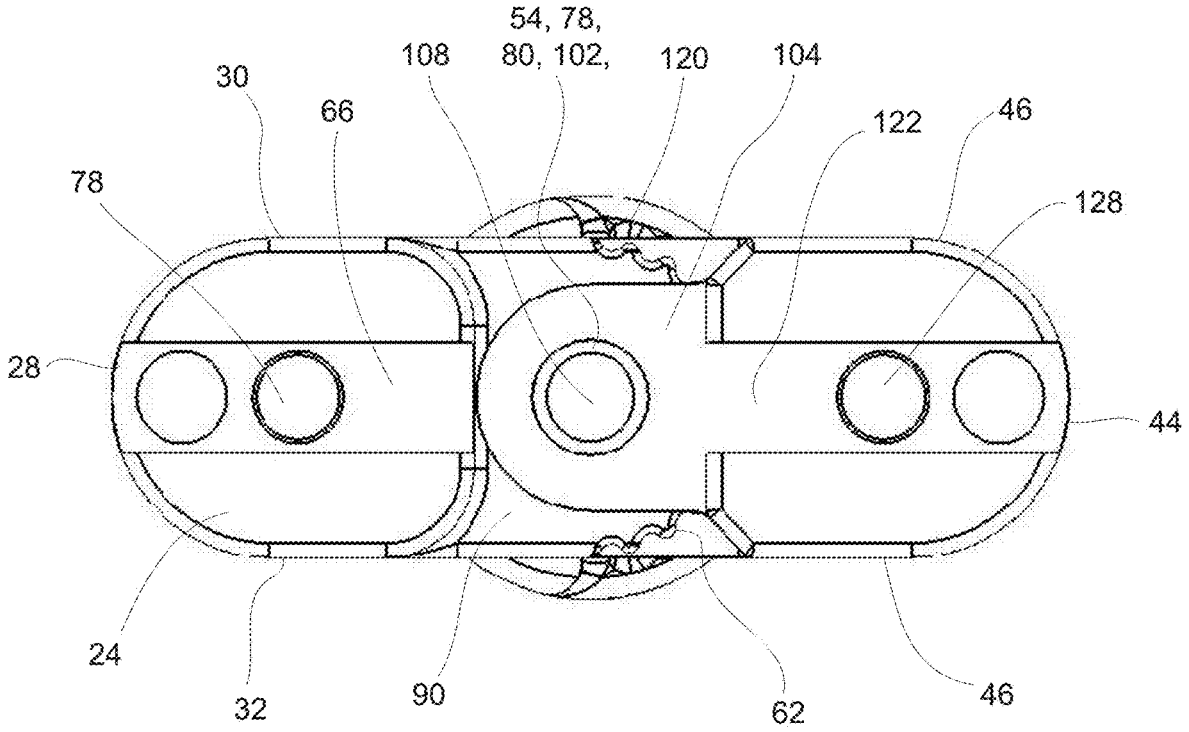
FIG. 3*d* is a bottom view of the first and second razor head members.

Referring now primarily to FIG. 3*c*, showing a side view of the second razor head member 18, the body 36 includes a T-shaped channel 122 adjacent the bottom surface 40, and extending between the front surface 42 and the back curved surface 44. Accordingly, the T-shaped channel 122 is formed between legs 124 and 126 with opposing feet 128, 130, and a top wall 132 connecting the legs 124, 126. A body bore 128 extends from the top surface 38 to the top wall 132. The top wall 132 is contiguous with the bottom surface 90 of the bottom disc-shaped plate 52.

Figure 4A:
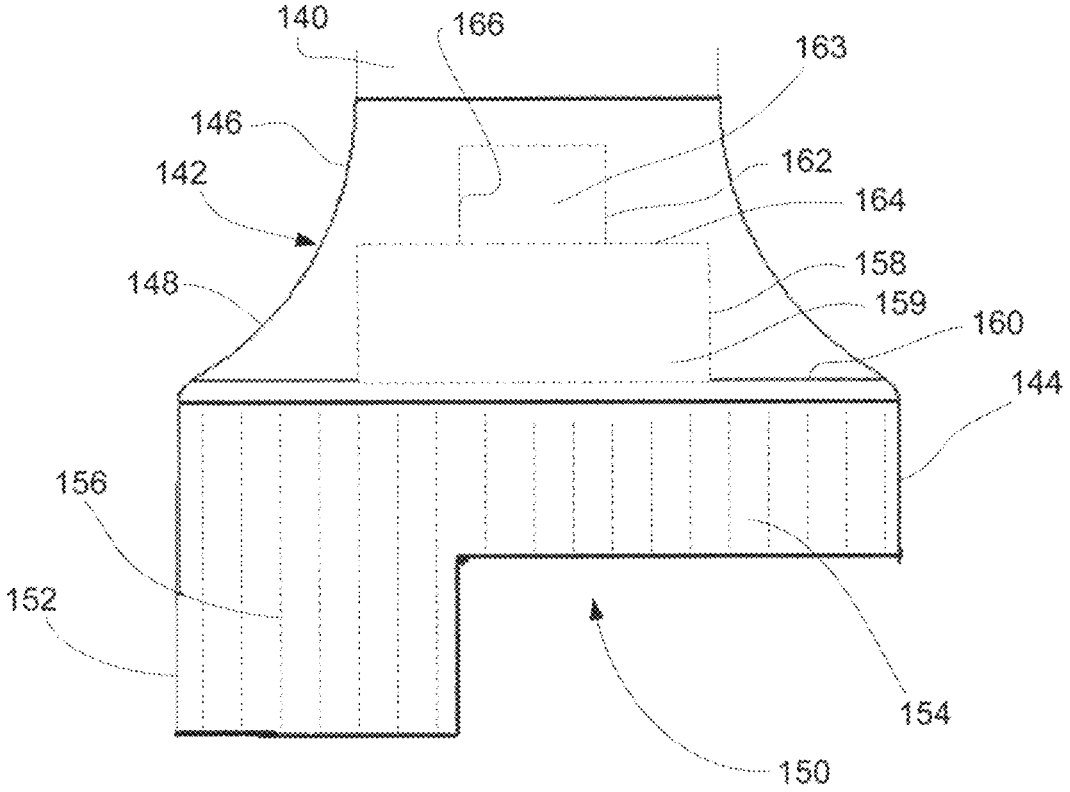
FIG. 4*a* is a perspective view of a frustoconical portion and a ring portion.
Figure 4B:
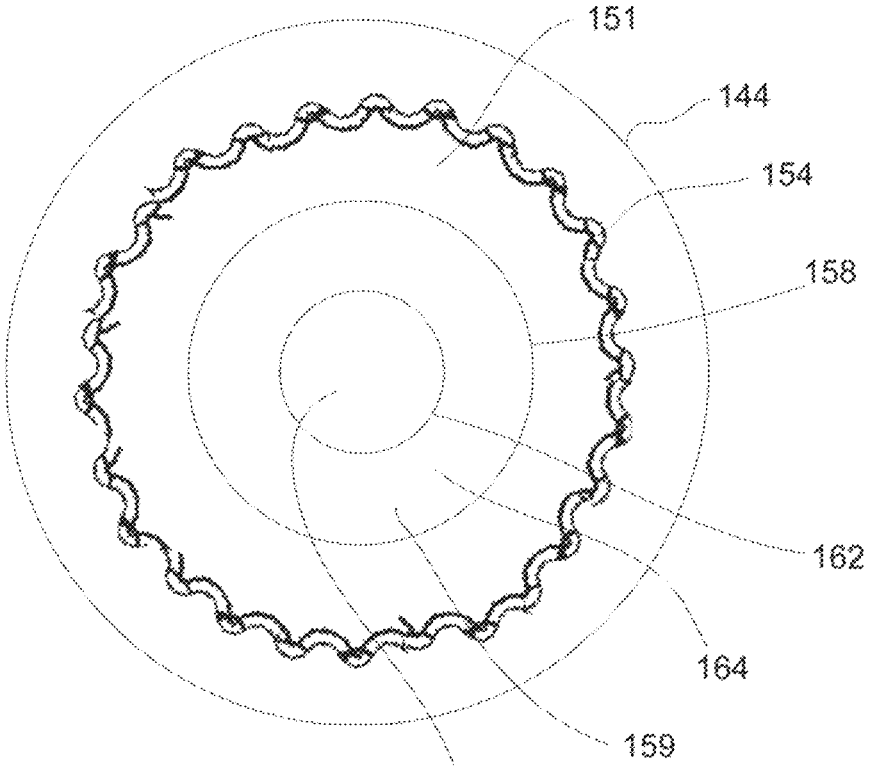
FIG. 4*b* is a bottom view of the frustoconical portion and the ring portion.
Figure 5A:
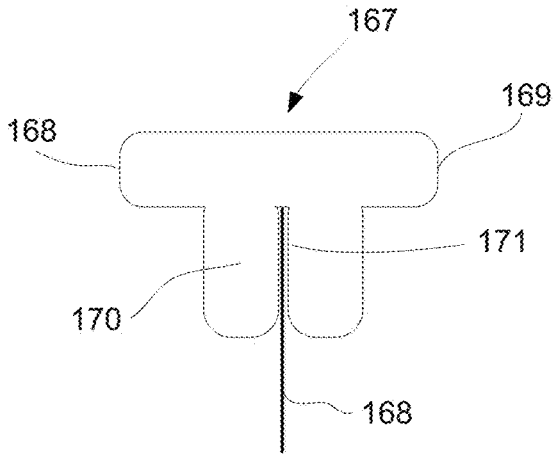
FIGS. 5*a* and 5*b* show perspective views of razor cartridges.
Figure 5B:
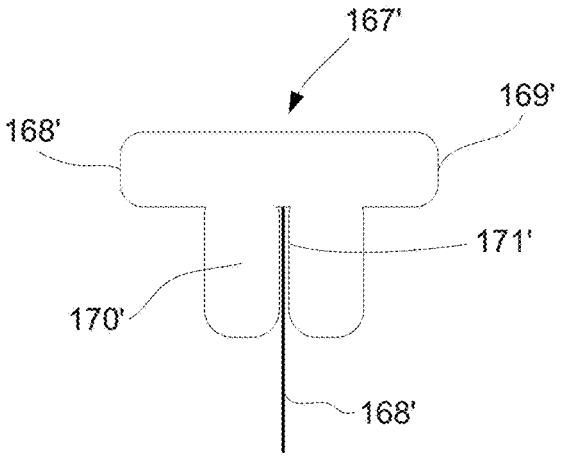
Figure 6:
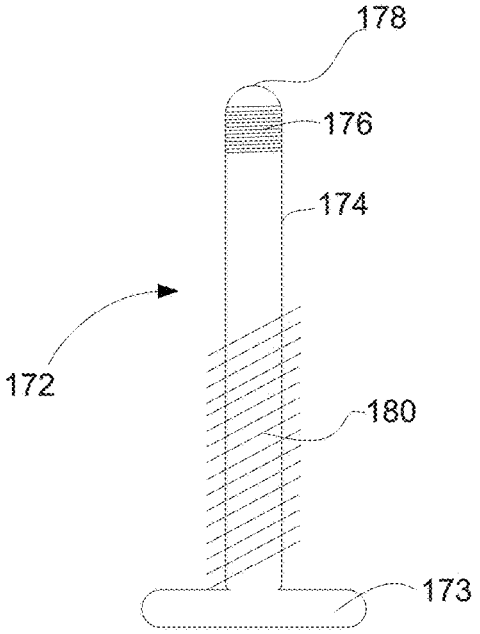
FIG. 6 is a perspective view of a fastening means.

Turning now to FIGS. 4*a* and 4*b*, the handle portion 12 comprises a handle 140, a frustoconical portion 142 and a ring portion 144. An upper part 146 of the frustoconical portion 142 is formed with the handle portion 140 while a lower part 148 of the frustoconical portion 142 is formed with the ring portion 144, and the ring portion includes an opening 150, with a ring cavity 151 formed therewithin. Depending downwardly from the ring portion 144 is a half ring 152, and the ring portion 144 and half ring 152 include internal radial gears 154, 156, respectively. The frustoconical portion 142 comprises a first reduced diameter bore 158 with a first cavity 159 such that a first annular transition shoulder 160 is formed between the internal radial gears 154 in opening 150 and the first reduced diameter bore 158. A second reduced diameter bore 162 with a second cavity 163 is formed within the frustoconical portion 142, and a second annular transition shoulder 164 is defined between the first reduced diameter bore 158 and the second reduced diameter bore 162. The second reduced diameter bore 162 includes an internal annular wall having threads 166 formed therein.

As stated above, the razor assembly 10 is assembled by receiving the disc-shaped finger 34 within the gap 54 between the top disc-shaped plate 50 and the bottom disc-shaped plate 52, such that the central bore 54 of the disc-shaped finger 34, and the bore 102 of top disc-shaped plate 50 and the bore 86 of the bottom disc-shaped plate 52, are aligned or lie on the same longitudinal axis. The radially protruding teeth 62 of geared ring 60 are in close proximity with the front surface 42 of the body 36 of the second razor head member 18 within the gap 54, and the rounded edge 84 abuts the front face 26 of body 20 of the first razor head member 16. The bottom surface 90 of the bottom disc-shaped plate 52 is along the same longitudinal axis of the top wall 76 of the T-shaped channel 66 of the first razor head member 16, such that the top wall 76 is substantially contiguous with the bottom surface 90 of the bottom disc-shaped plate 52.

The T-shaped channel 66 receives a T-shaped cartridge 167 which carries a razor blade member 168. The T-shaped cartridge 167 is a unitary formed member comprising a pair of arms 168, 169 and a stem 170 having a channel 171 for receiving the razor blade member 168. The T-shaped cartridge 167 is slid into the T-shaped channel 66 of the first razor head member 16 via the curved back surface 28, such that the arms 168, 169 are secured between the legs 68, 70 and the top wall 76, while the stem 170 abuts the opposing feet 72, 74. Correspondingly, the T-shaped channel 122 receives a T-shaped cartridge 167' which carries a razor blade member 168'. The T-shaped cartridge 167' is a unitary formed member comprising a pair of arms 168', 169' and a stem 170' having a channel 171' for receiving the razor blade member 168'. The T-shaped cartridge 167' is slid into the T-shaped channel 122 of the second razor head member 18 via the curved back surface 44, such that the arms 168', 169' are secured between the legs 124, 126, and the top wall 132, while the stem 170' abuts the opposing feet opposing feet 128, 130. Preferably the razor assembly 10 comprises disposable cartridges 167, 167' having a razor blade member 168 or 168'.

As mentioned above, a fastening means retains the handle portion 12, the first razor head member 16 and the second razor head member 18 together. An exemplary fastening means is a screw 172 having a screw head 173, a threaded body 174 with threads 176 and a distal end 178. The screw 172 is associated with a resilient means, such as a spring 180 or elastomeric member, resting on the screw head 173. The screw 172 bearing the spring 180 is received by bores 86, 54 and 102 in a pin and slot arrangement, such that the spring 180 is retained between the screw head 173 and the annular shoulder 114, and the distal end 178 of the screw 172 extends beyond the top surface 112 of the nipple 100. The screw 172 thus rotatably mounts the first razor head member 16 and the second first razor head member 18.

The body bore 78 extending from the top surface 22 to the top wall 76 and the body bore 128 extending from the top surface 38 to the top wall 132 comprise screws 182, 182' which are threadably received therein.

The handle portion 12 is coupled to the second razor head member 18 when the nipple 100 is introduced in the first cavity 159 such that the top surface 112 of the nipple 100 abuts the first annular transition shoulder 160. The distal end 178 of the screw 172 is threadably received by the second reduced diameter bore 162 of the handle portion 12. As the screw 172 is received, starting in a first position the teeth 120 of semi-circular geared portion 116 of the second razor head member 18 engage the radial gears 154 of the ring portion 144, and the gear teeth 120 of the semi-circular geared portion 116 engage the internal radial gears 156 of the half ring 152. The spring 180 biases the frustoconical portion 142 against the first razor head member 16 and the second razor head member 18, such that the ring portion 144 rests on the top surface 98 of the second razor head member 18. The half ring 152 is received in the arcuate recess 66 between the portion of geared ring 60 above the gear-less finger portion 64 and the front surface 26, and the gears 156 of the half ring 152 engage the gear teeth 62 of the first razor head member 16. In this configuration, the first razor head member 16 and the second razor head member 18 are locked in place by the frustoconical portion 142, and can not rotate about the screw 172.

In order to move the apparatus 10 into a second position, a force is applied to the frustoconical portion 142 to unbiase the spring 180 such that the force is sufficient to cause the gear 156 of the half ring 152 to disengage the geared ring 60 of the disc-shaped finger 34, while maintaining the engagement between the teeth 120 of semi-circular geared portion 116 of the second razor head member 18 and the radial gears 154 of the ring portion 144. Accordingly, the first razor head member 16 is now able to rotate about the screw 172, while the second razor head member 18 and the frustoconical portion 142 stay in a locked arrangement via the teeth of gears 154, 156 and gear teeth 120 engagement. When the first razor head member 16 is in the desired second, the force is removed and the spring 172 biases the gears of the half ring 152 against the geared ring 60 of the disc-shaped finger 34, and lock the first razor head member 16 and the second razor head member 18. Accordingly, the first razor head member 16 can be placed in a plurality of positions relative to the second razor head member 18, as dictated by the meshing of the gears 156 of the frustoconical portion 142 and gear teeth 62 of the first razor head member 16. The positioning thus also depends on the pitch of gear 62 on the first razor head member 16, gears 154, 156 on the frustoconical portion 142, and gears 120 on the second razor head member 16.

In an exemplary manner of operation of the razor assembly 10 by a user, the T-shaped cartridge 167 bearing a razor blade member 168 is slid into the T-shaped channel 66 of the first razor head member 16 via the curved back surface 28; and correspondingly, the T-shaped cartridge 167' is slid into the T-shaped channel 122 of the second razor head member 18 via the curved back surface 44. By applying a force to the frustoconical portion 142, the spring 170 is unbiased to allow rotation of the first razor head member 16 about the screw 172, while the second razor head member 18 and the frustoconical portion 142 stay in a locked together. Accordingly, the first razor head member 16 and the second razor head member 18 may be placed into a plurality positions relative to each other, and the positions correspond to a plurality of curve profiles which are suitable for effecting the desired particular facial hair styles, as will be described below. The user then grasps the handle portion 12 and positions the razor blades 168, 168' on the surface area to be styled, such as hair-lines, sideburns, moustaches, and beards, to effectively trim or sculpt those areas. Following use, the razor assembly 10 may be easily cleaned using conventional cleaning methods, such as placing the razor assembly 10 under a running tap, or brushing off the hair. However, if a thorough cleaning is mandated, then the razor assembly 10 may be easily disassembled by unthreading the screw 172 from the frustoconical portion 142, and separating the first razor head member 16 and the second razor head member 18 from each other. Once disassembled, the individual parts of the razor assembly 10 may be cleaned, or serviced.

Figure 7A:
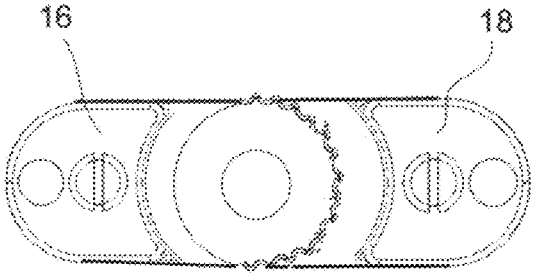
FIGS. 7*a* to 7*e* show various curve profiles of the razor assembly.

FIG. 7*a* shows an exemplary first curve profile in which the first razor head member 16 is at 0° with respect to the second razor head member 18. Accordingly, this exemplary first curve profile places the two razors 168 and 168' along the same longitudinal axis such that the configuration of the two razors 168 and 168' causes the razor assembly to function as a typical straight razor.

Figure 7B:
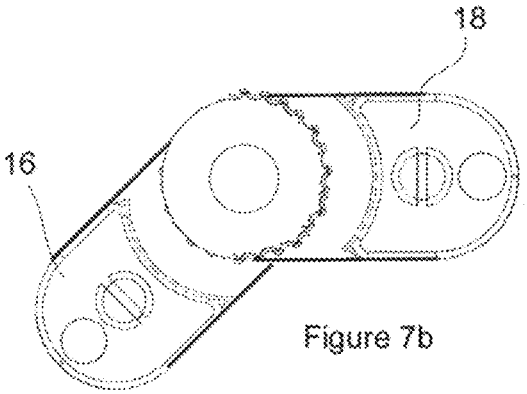

FIG. 7*b* shows an exemplary second curve profile in which the first razor head member 16 is at approximately 45° with respect to the second razor head member 18, such that the exemplary second curve profile is substantially V-shaped.

Figure 7D:
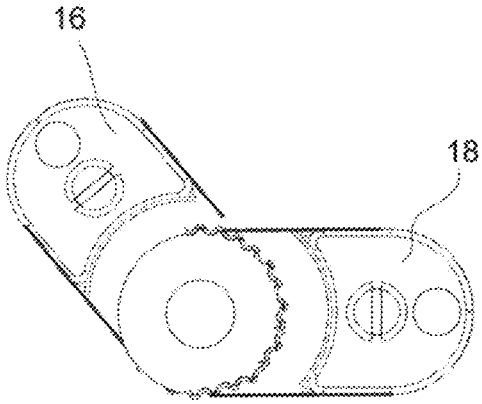
Figure 7C:
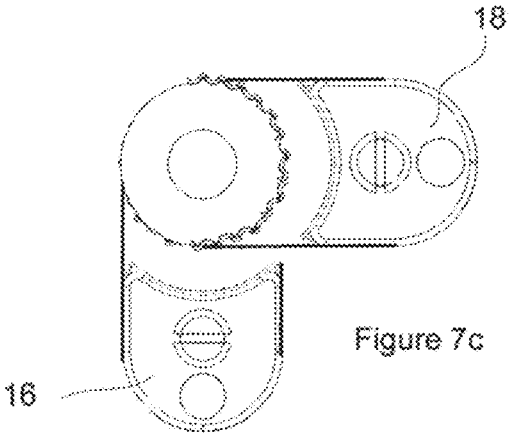

FIG. 7*c* shows an exemplary third curve profile in which the first razor head member 16 is at approximately 90° with respect to the second razor head member 18, such that the exemplary second curve profile is substantially L-shaped.

FIG. 7*d* shows an exemplary second curve profile in which the first razor head member 16 is at approximately −45° with respect to the second razor head member 18, such that the exemplary second curve profile is substantially V-shaped.

Figure 7E:
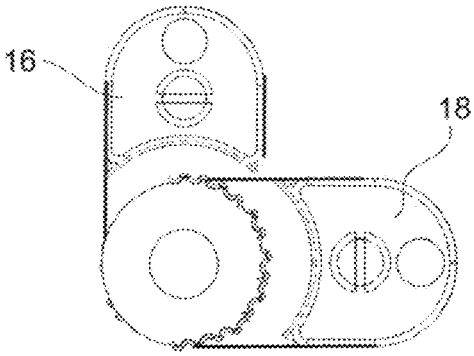

FIG. 7*e* shows an exemplary third curve profile in which the first razor head member 16 is at approximately −90° with respect to the second razor head member 18, such that the exemplary second curve profile is substantially L-shaped.

As can be deduced, multiple curve profiles are possible by placing the first razor head member 16 at a plurality of angles relative to the second razor head member 16, in which the angle ranges from 0° to 90° and 0° to −90°, for a 180° span.

In another embodiment, a single cartridge is employed, and extends between channel 66 of body 20 to channel 122 of body 36, and holds a single razor blade member dimensioned to extend between channel 66 of body 20 to channel 122 of body 36. Accordingly, both the cartridge and the razor are resilient, flexible or bendable and are capable of being place in a plurality of positions as described above.

In another embodiment, the edges of the blades 168, 168' are coloured such that the point of contact of the blade edge with the surface having hair is more visible to the user. The increased visibility of the blade edge against the skin allows the user to better develop outline profiles, which results in better results.

In another embodiment, the blade portion 206 is transparent to enhance visibility of the location of the blade member 168, 168' on the shaving site.

In another embodiment, the handle portion, first razor head member 16 and the second razor head member 18 are formed together as a unitary part, wherein the razor head 14 comprises a first razor head member 16 and a second razor head member 18 are disposed at a fixed angle relative to each other. As an example, the set angles may correspond to curve profiles described above, or other desired curve profiles.

In another embodiment, the razor assembly 10 comprises a handle portion for receiving a plurality of interchangeable razor heads 14, in which the first razor head member 16 and the second razor head member 18 are formed together as a unitary part, and wherein the first razor head member 16 and the second razor head member 18 are disposed at a fixed angle relative to each other. As an example, the set angles may correspond to curve profiles described above, or other desired curve profiles.

Figure 8A:
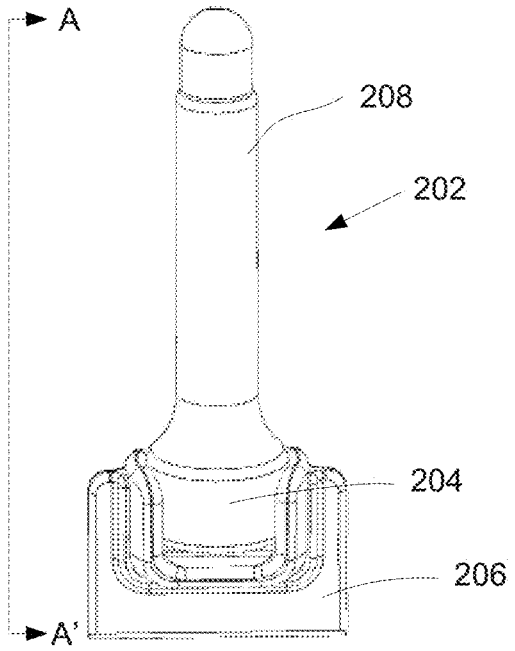
FIG. 8*a* is a perspective view of a razor assembly, in another embodiment.
Figure 8B:
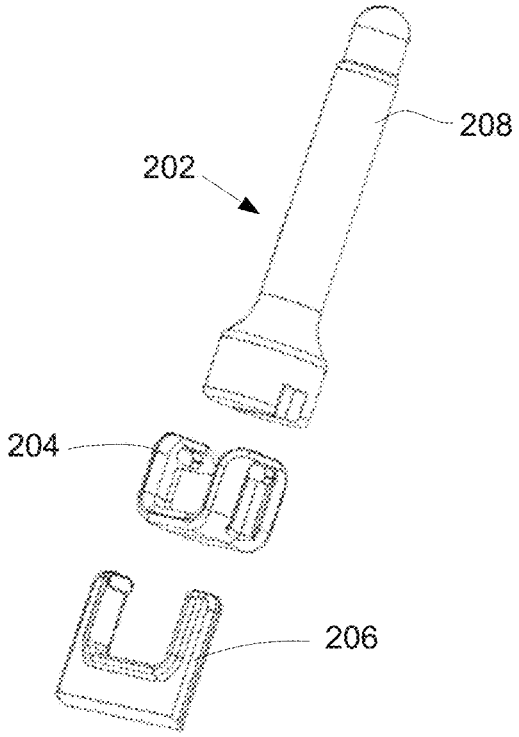
FIG. 8*b* shows an exploded view of the razor assembly of FIG. 8*a;*
Figure 8C:
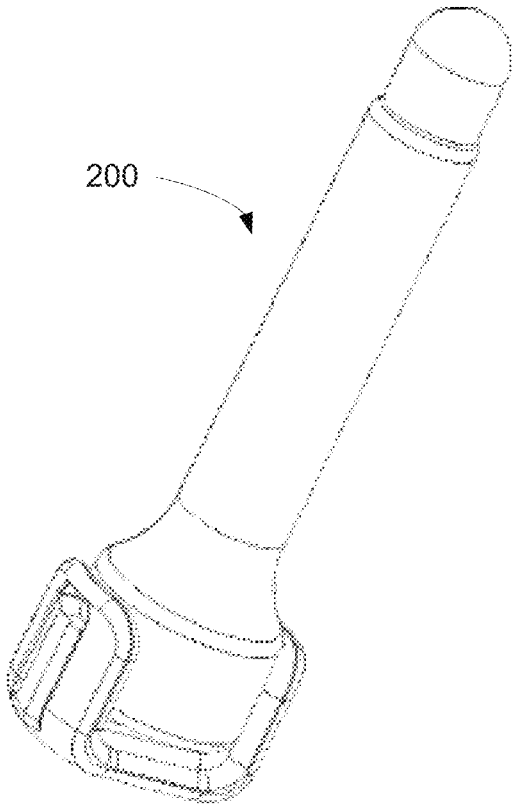
FIG. 8*c* shows a unitary razor assembly.

In yet another embodiment, there is shown a razor assembly generally designated by the numeral 200 in FIGS. 8*a* and 8*b*. The razor assembly 200 comprises a handle portion 202, a blade support 204 having a blade cartridge 206. FIG. 8*c* shows a unitary razor assembly 200.

Figure 9:
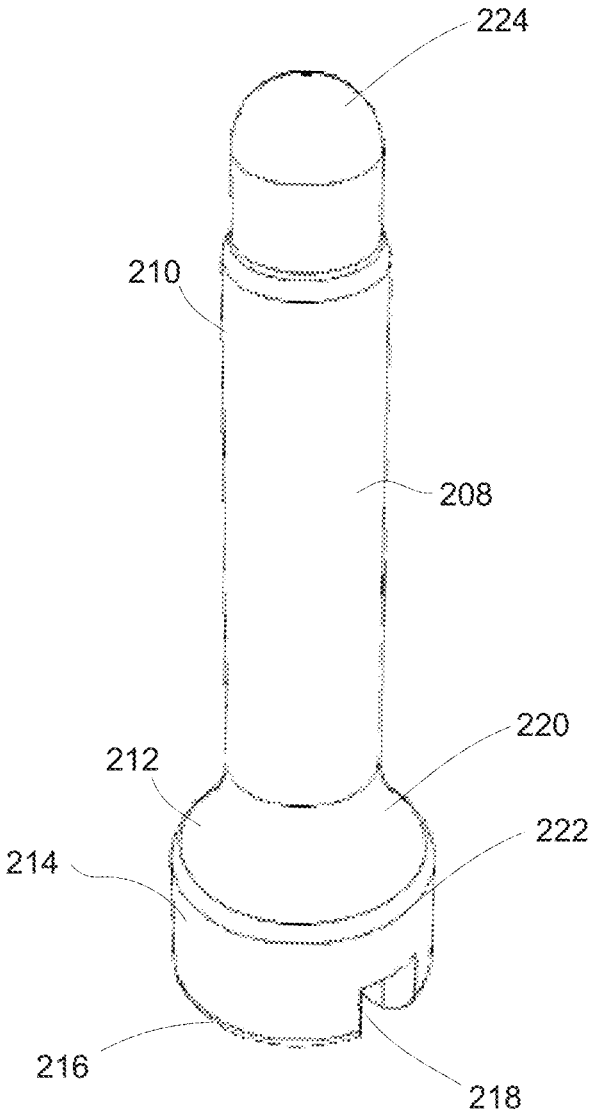
FIG. 9 is a perspective view of a handle portion.

Referring now primarily to FIG. 9, showing a side view of the handle portion 202. As can be seen, the handle portion 202 comprises a handle 208 extending from one end 210 to another end 212, and a frustoconical portion 214 intermediate the other end 212 and a ring portion 216, and integrally formed therewith. Defined within ring portion 216 is a channel 218 extending between opposing edges of the ring portion 216 and through the center thereof. Channel 218 is dimensioned to fixedly receive blade support 204.

Figure 10:
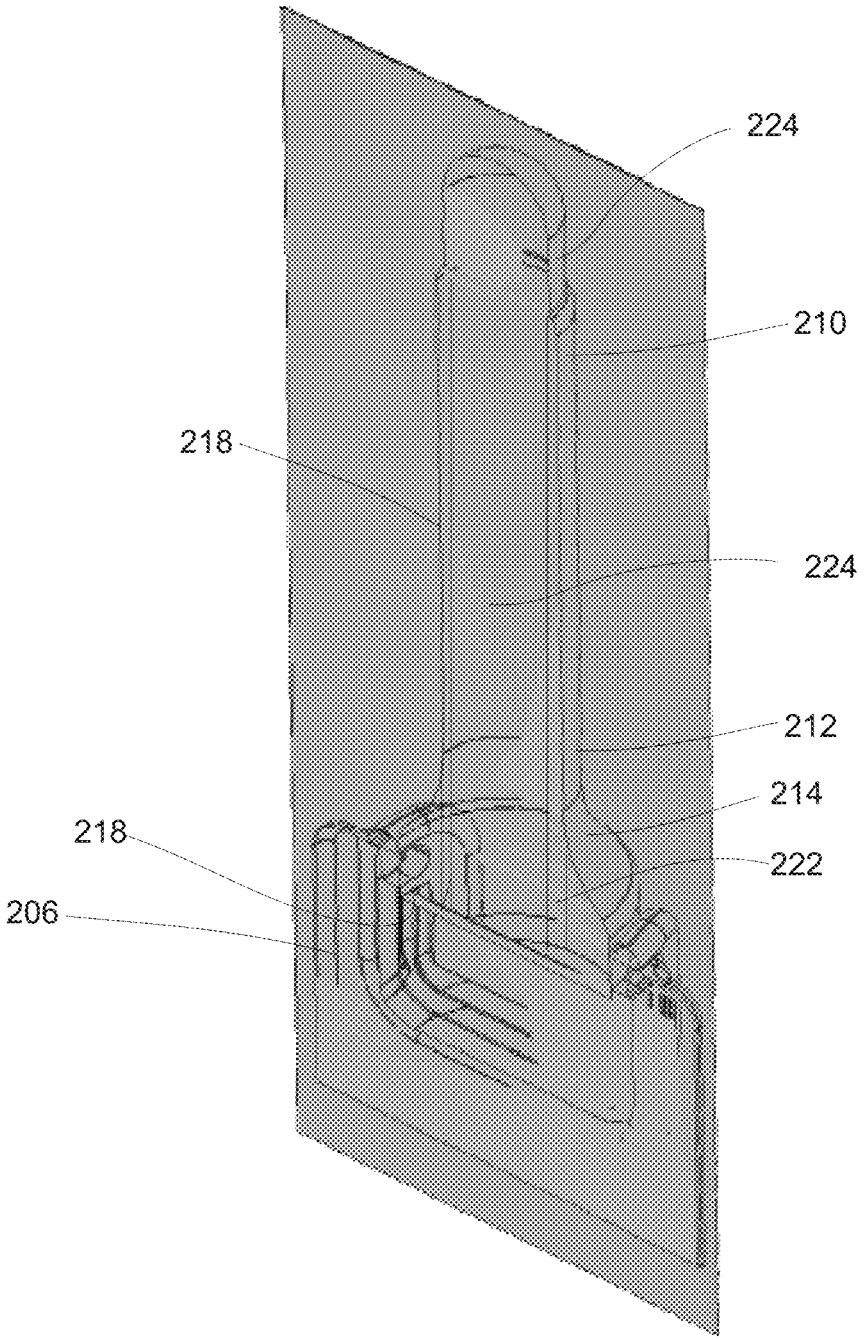
FIG. 10 shows a sectional view of the razor assembly of FIG. 8*a* along line A-A'.

Looking at FIG. 10, handle portion 202 includes an axial bore 220 extending between ends 210 and 212. An equally dimensioned axial bore 222 extends through frustoconical section 214 and partially through ring portion 216 terminating about midway of the length of channel 218. An actuating rod 224 is accommodated in axial bore 220 and axial bore 222 for movement therein to urge the blade cartridge 206 out of the channel 218, as will described later.

Figure 11:
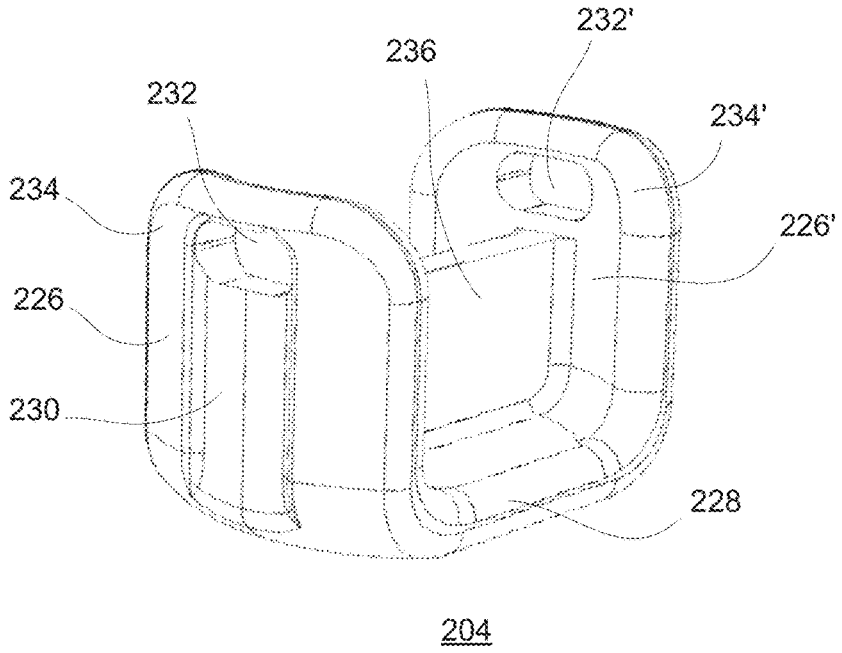
FIG. 11 shows a perspective view of a blade support.

As can be seen in FIG. 11, blade support 204 is generally U-shaped and includes a pair of upstanding walls 226, 226' interconnected by a base 228. Disposed on the exterior of walls 226, 226', and midway thereof, is a guide track 230, 230' (not shown), extending from near base 230 to near top end 234, 234' of walls 226, 226'. An orifice 232, 232' is defined within guide track 230, 230' near top end 234, 234' of walls 226, 226'. Projecting upwardly from base 228 and abutting the interior of walls 226, 226' is a plate member 236 dimensioned to be received in channel 218 of ring portion 216. Plate member 236 is disposed on the interior of walls 226, 226' opposite guide tracks 230, 230' and terminates adjacent orifices 232, 232'.

Figure 12A:
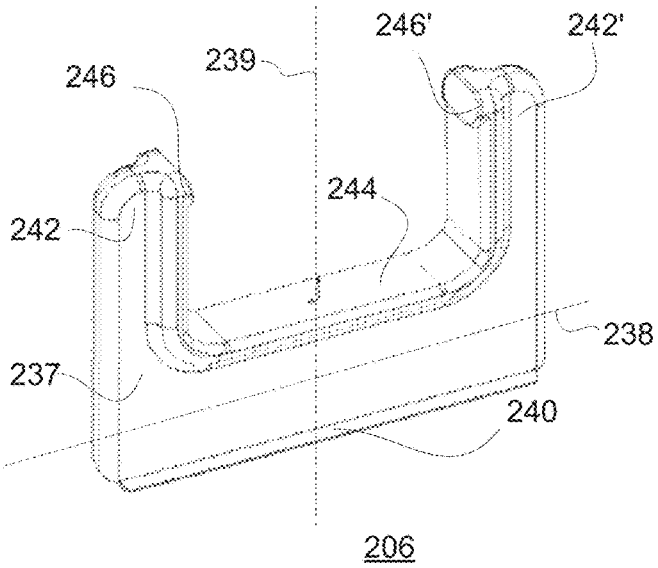
FIG. 12*a* shows a perspective view of an exemplary blade cartridge.

Now turning to FIG. 12*a*, there is shown the blade cartridge 206 in greater detail. Blade cartridge 206 includes a body 237 having a longitudinal axis 238 and vertical axis 239, and securely holds a blade member 240 along the longitudinal axis 238. Blade cartridge 206 is adapted to be removably coupled to blade support 204, as will be described shortly. Generally, body 237 is a U-shaped and comprises a pair of resilient arms 242, 242' parallel to the vertical axis 239 and interconnected by a midsection 244. Resilient arms 242, 242' are dimensioned to be snapped onto the blade support 204. Accordingly, arms 242, 242' include a pair of protruding lips 246, 246' facing each other adjacent the extremities of arms 242, 242'. The protruding lips 246, 246' are dimensioned to engage the guide tracks 230, 230' and are urged along thereon until the protruding lips 246, 246' click into place within orifices 232, 232' to fixedly maintain the protruding lips 246, 246' within the orifices 232, 232' and arms 242, 242' within guide tracks 230, 230'. Alternatively, the body is placed adjacent to the orifices 232, 232' in a parallel arrangement, and a force substantially perpendicular to the longitudinal axis is applied to arms 242, 242' to cause the protruding lips 246, 246' into the orifices 232, 232'. As such, blade cartridge 206 is securely held on the blade support 204 when the apparatus 200 is in operation.

In order to remove the blade cartridge 206 from the blade support 204 a force is applied to dislodge the protruding lips 246, 246' from the orifices 232, 232' and urge the protruding lips 246, 246' down the guide tracks 230, 230' towards the base 228 until the protruding lips 246, 246' are free of the guide tracks 230, 230'. Alternatively, a force substantially perpendicular to the longitudinal axis is applied to arms 242, 242' to extricate the protruding lips 246, 246' out of the orifices 232, 232'. As noted above, the actuating rod 224 may be urged along axial bore 218, bore 220 and axial bore 222 towards the channel 218 in order to urge the blade cartridge 206 out of the channel 218. A resilient member, such as spring means, may be associated with rod 224 to return the rod 224 to a rest position after forcing out the blade cartridge 206 out of channel 218, and retain rod 224 within axial bore 218, bore 220 and axial bore 222.

Figure 12B:
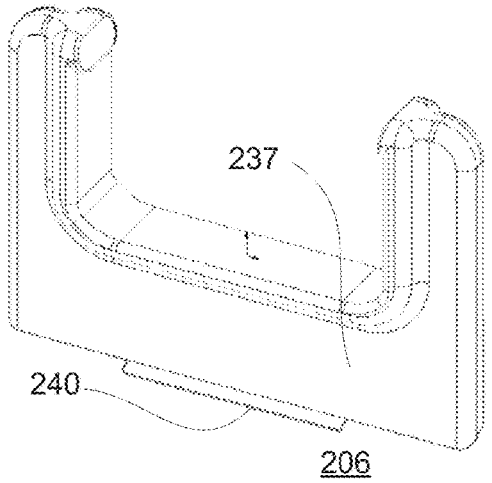
FIG. 12*b* shows a perspective view of another exemplary blade cartridge blade cartridge.

In another embodiment, blade member 240 is reduced in size and secured at a predetermined location on longitudinal edge of body 237, as shown in FIG. 12*b*. The reduced size blade member 240 is dimensioned and located to suit particular shaving styles or profiles, and is useful for hard to reach areas, or particularly challenging shaving styles or profiles that require increased accuracy.

In another embodiment, blade member 240 is reduced in size and secured at a predetermined location on longitudinal edge of body 237, as shown in FIG. 12*b*.

Figure 12C:
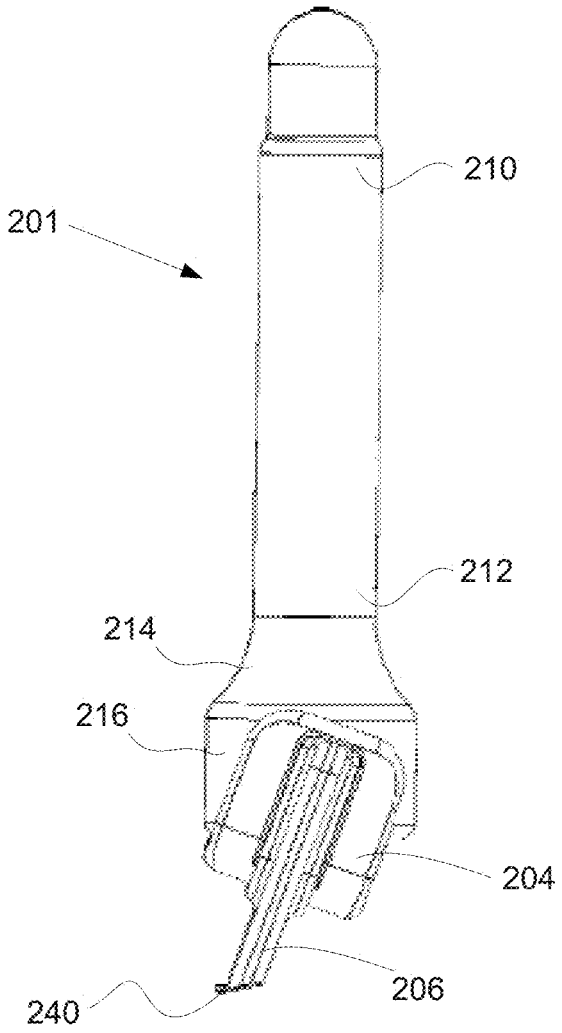
FIG. 12*c* shows a perspective view of razor assembly with a pivoting blade cartridge.

In yet another embodiment, blade support 204 pivotable about the handle 208, as shown in FIG. 12*c*. Accordingly, rod 224 extending through the handle 208 and blade support 204 comprises gear teeth lockable in place to allow the blade support to be locked in a plurality of incremental positions relative to handle 208.

In another embodiment, rod 224 includes threads which mesh with complementary threads on walls of one of axial bore 220 and axial bore 222, to translate the actuating rod 224 along bores 220 and 222.

In another embodiment, the blade portion 206 or body 237 is transparent to enhance visibility of the location of the blade member 168 or 240 on the shaving site.

In another embodiment, handle portion 202 and blade support 204 are integrally formed, such that a disposable blade cartridge 206 is snapped on or off the blade support 204. Accordingly, the unitary body comprising the handle portion 202 and blade support 204 may be formed of plastic or stainless steel.

In another embodiment, as shown in FIGS. 13*a*, 13*b*, 13*c* and 13*d*, a blade cartridge 250 includes a body 254 having a longitudinal axis 256 and vertical axis 258, and securely holds a blade member 260 at an edge of body 254, longitudinally. Body 254 includes a U-shaped portion comprising a pair of resilient arms 262, 262' interconnected by a midsection 264, and is dimensioned to be snapped on to the blade support 204. Depending from midsection 264 and forming an angle with the vertical axis 258 is a blade portion 266 having blade member 260.

In another embodiment, the blade portion 254 is transparent to enhance visibility of the location of the blade member 260 on the shaving site.

Figure 13A:
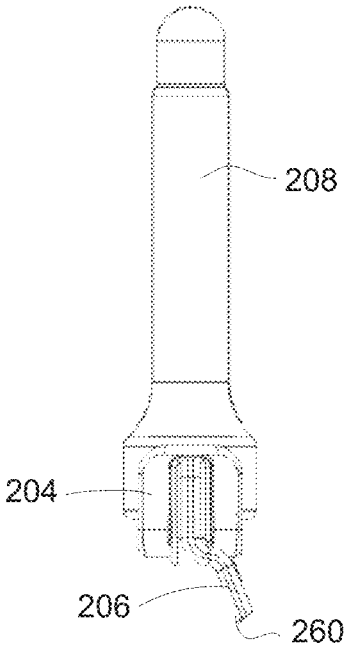
FIG. 13*a* shows a razor assembly with an angled blade cartridge, in another embodiment.
Figure 13B:
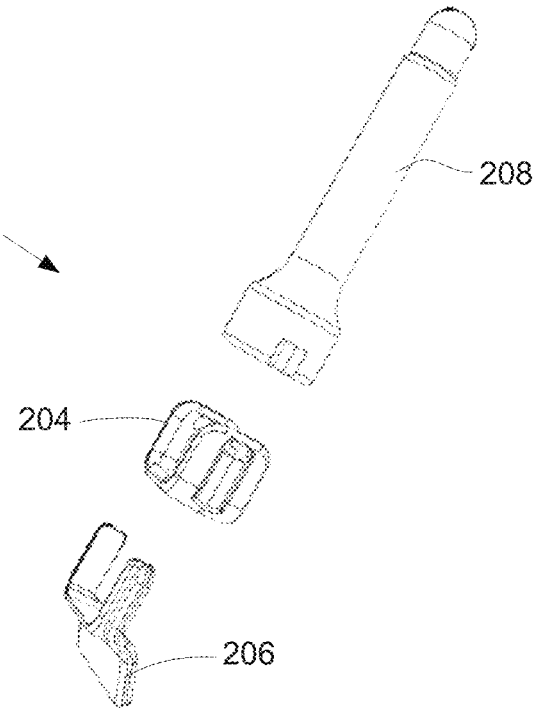
FIG. 13*b* shows an exploded view of the razor assembly of FIG. 13*a;*
Figure 13C:
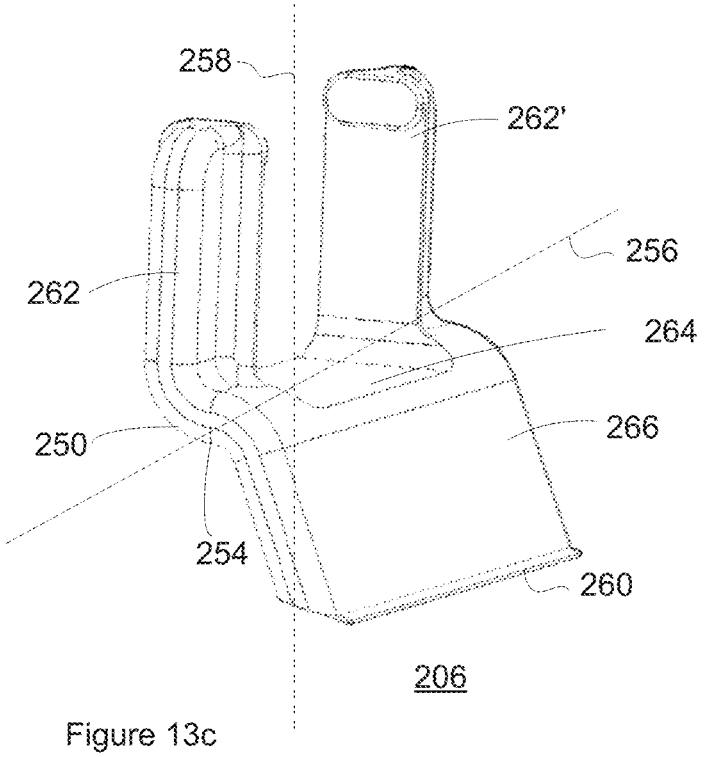
FIGS. 13*c* and 13*d* show a razor assembly with an angled blade cartridge, in yet another embodiment.
Figure 13D:
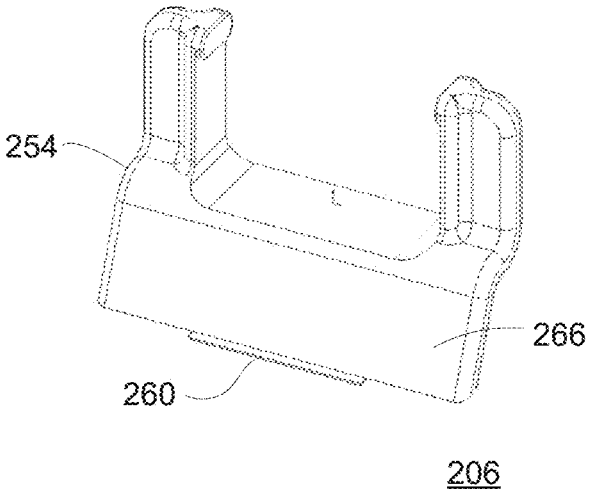

In another embodiment, blade member 260 is reduced in size and secured at a predetermined location on longitudinal edge of body 254, as shown in FIG. 13*d*. The reduced size blade member 260 is dimensioned and located to suit particular shaving styles or profiles, and is useful for hard to reach areas, or particularly challenging shaving styles or profiles that require increased accuracy. Alternatively, other blade cartridge configurations may be coupled to the blade support 204, to effect a desired shaving profile, as shown in FIGS. 18*a* to 18*c*, and 19, as will be described later.

Figure 14A:
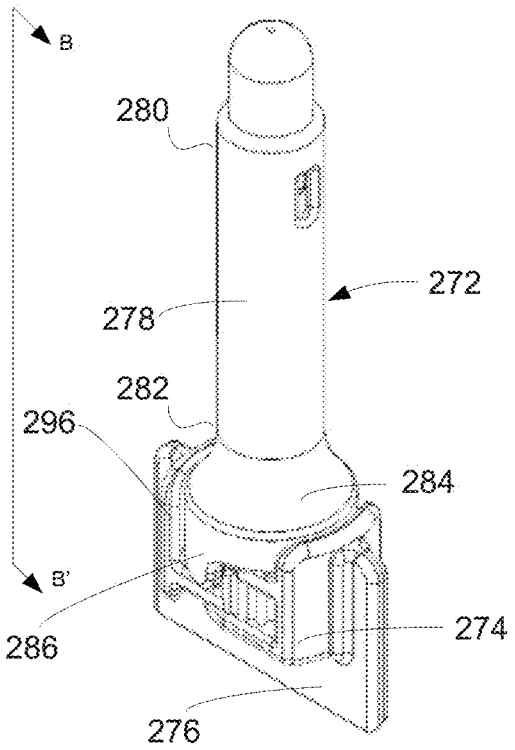
FIGS. 14*a* and 14*b* show exemplary curved blade cartridges.
Figure 14B:
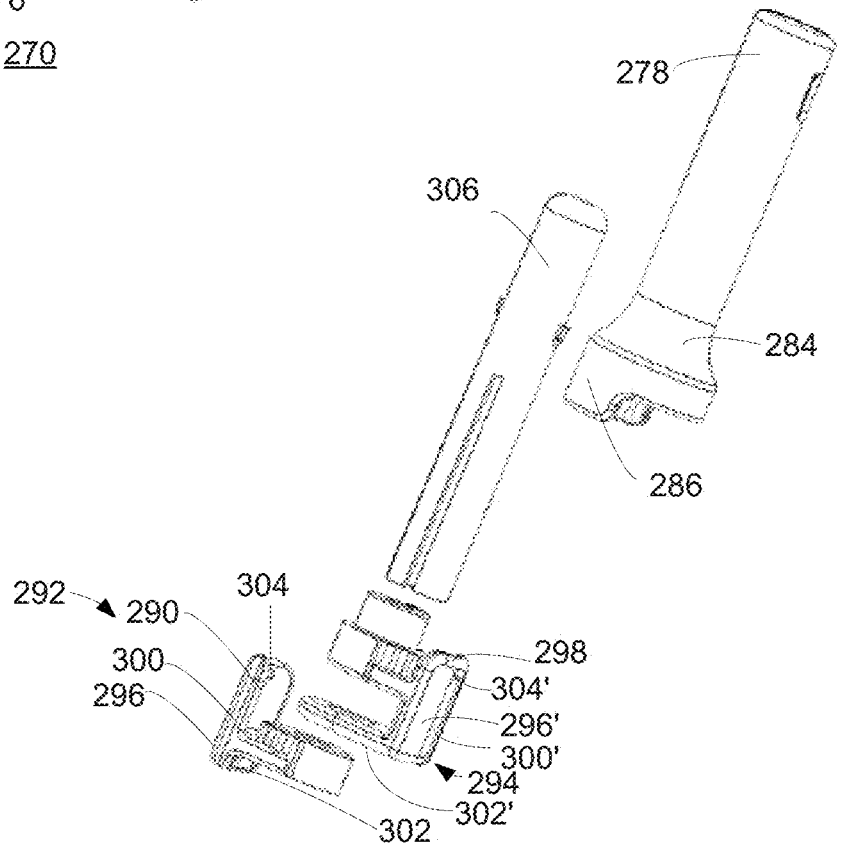

In yet another embodiment, as shown in FIGS. 14*a* and 14*b*, a razor assembly 270 having a handle portion 272, and a blade support 274 having a blade cartridge 276. Handle portion 272 comprises a handle 278 extending from one end 280 and another end 282, a frustoconical portion 284 intermediate between end 282 and a ring portion 286, and half ring 287. Razor assembly 270 also includes a blade support 274 having first member 292 similar to first razor head member 16 of FIGS. 2*a* and 2*b*, and a second member 294 similar to second razor head member 18 of FIGS. 3*a* and 3*b*. Accordingly, gear teeth of first member 292 and second member 294 intermesh such that first member 292 and second member 294 are able to pivot relative to each other, as described with reference to the embodiment shown in FIGS. 1 to 7. Similar to the blade support 204, first member 292 includes a first upstanding wall 296 having an exterior guide track 300 disposed thereon, and midway of the width of the wall 296, extending from near base 302 to near top end 304 of wall 296. An orifice 304 is defined within guide track 300 near top end 304 of walls 296. Similarly, second member 294 includes a second upstanding wall 296' having an exterior guide track 300' disposed thereon, and midway of the width of the wall 296', extending from near base 302' to near top end 304' of wall 296'. An orifice 304' is defined within guide track 300' near top end 304' of wall 296'.

Figure 15B:
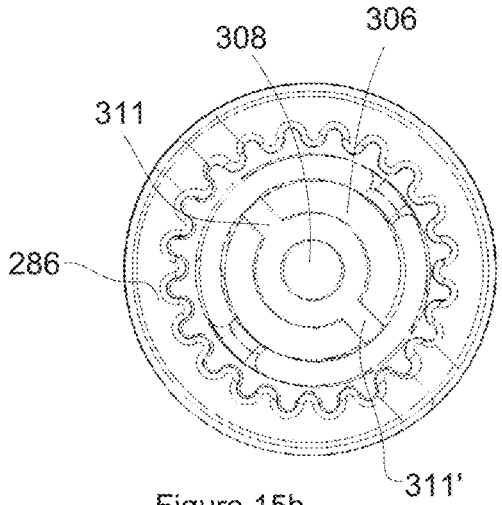
FIG. 15*b* shows a bottom view of the handle portion.

Similar to blade cartridge 206, blade cartridge 276 is securedly held on the blade support 274 when the apparatus 270 is in operation. Razor assembly 270 also includes an actuating rod 305 for adapting the angle between the first member 292 and second member 294, to place the first member 292 in a plurality of positions relative to the second member 294, similar to the method of operation described above in accordance to the embodiment of FIGS. 1 to 7. Looking at FIGS. 15*a* and 15*b*, handle 278 includes an axial bore 306 extending between ends 280 and 282, with an interior rod 307 within the axial bore 306, and extending from end 282 to about midway of handle portion 272. The interior rod 307 includes with a concentric axial bore 308 defined by rod wall 310, such that exterior rod wall 310 is joined to the interior wall of axial bore 306 by opposing arms 311, 311'. Actuating rod 305 is accommodated in axial bore 306 for movement therein. As shown in FIG. 15*c*, actuating rod 305 includes a hollowed-out section 312 extending from bottom end 313 and terminating at about two thirds of the actuating rod 305, and adjacent to top end 314. The hollowed-out section 312 includes a pair of walls 315, 315' separated by opposing axial channels 316, 316'. Actuating rod 305 also includes a pair of opposing detents 317, 317' protruding therefrom, adjacent to top end 314.

Figure 15A:
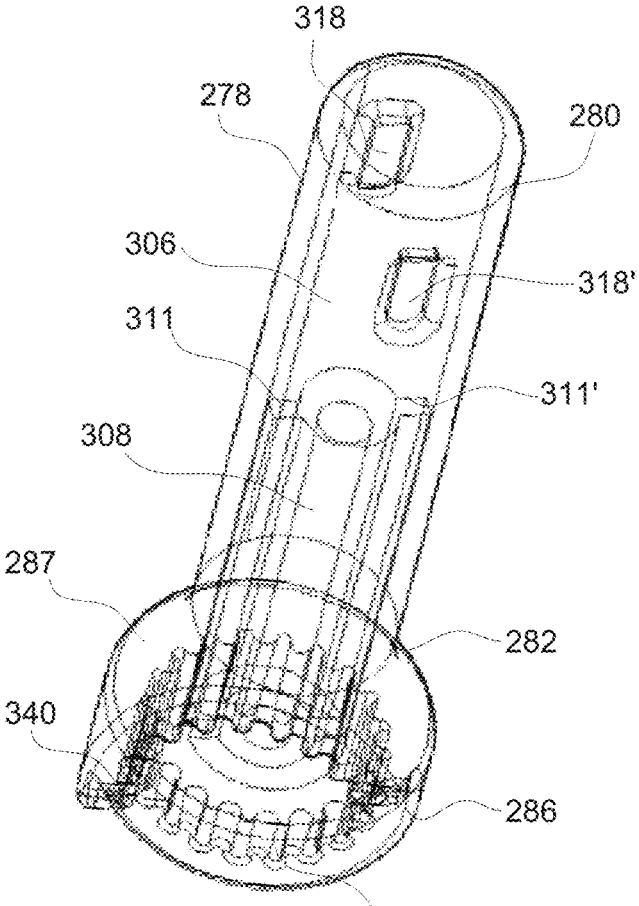
FIG. 15*a* shows a handle portion.
Figure 15C:
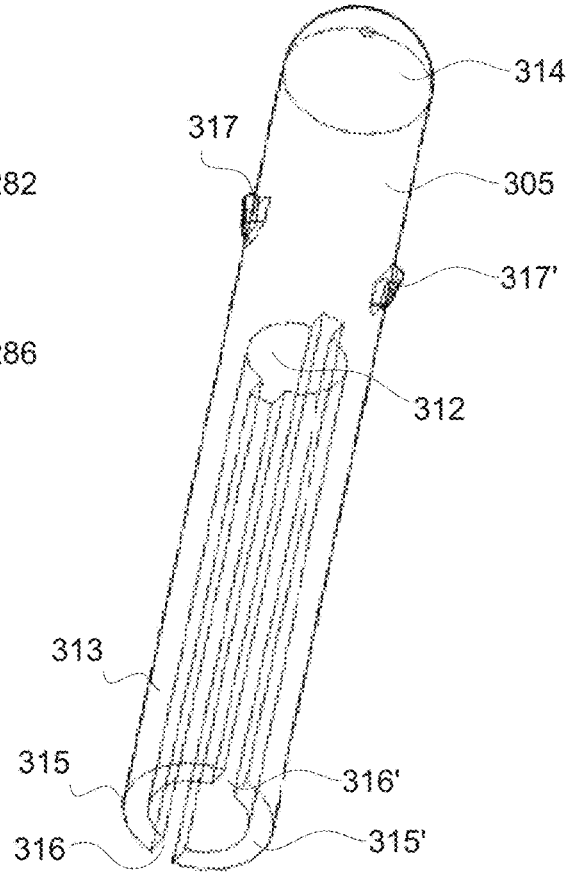
FIG. 15*c* shows an actuating rod.
Figure 16:
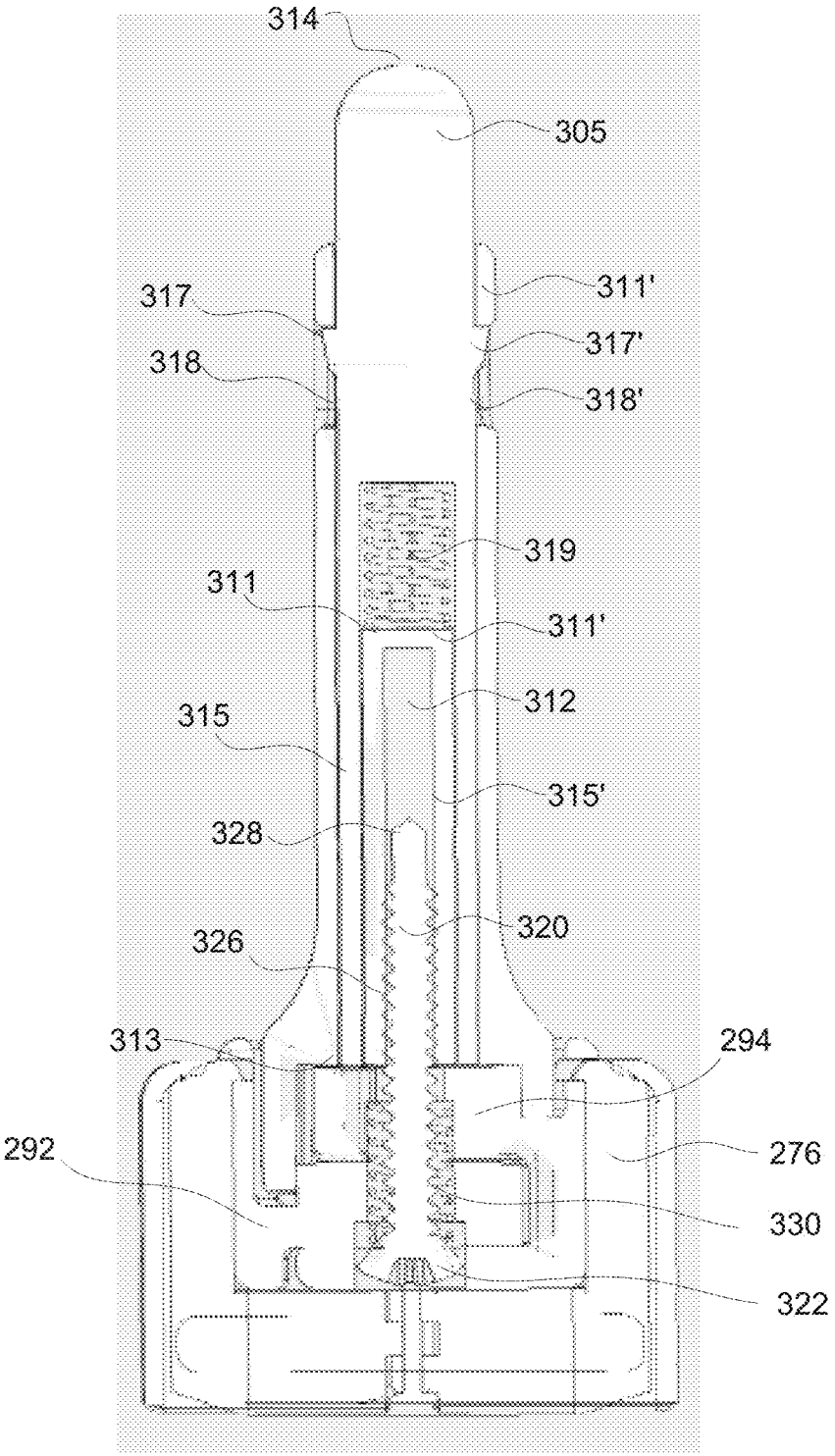
FIG. 16 shows a cross-sectional view of the razor assembly of FIG. 15*a*, along line B-B'.
Figure 17:
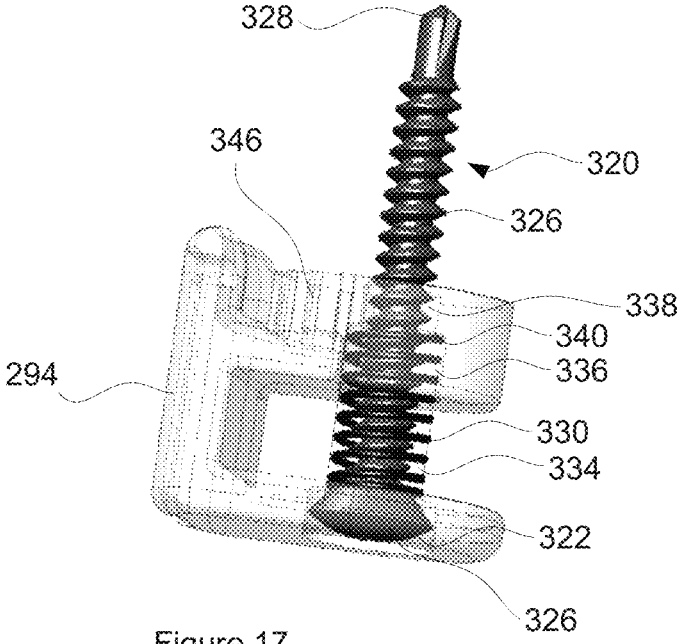
FIG. 17 shows a portion of an actuating mechanism.

As depicted in FIG. 16, a cross-sectional view of the razor assembly 270 of FIG. 15*a*, along line B-B', detents 317, 317' are received within opposing channels 318, 318' in handle 278. Sitting on opposing arms 311, 311' and within hollowed-out section 312 is a resilient means, such as a spring 319 or elastomeric member. As previously stated, a fastening means retains the handle portion 272, the first member 292 and the second member 294 together. Looking at FIG. 17, an exemplary fastening means is a screw 320 having a screw head 322, a threaded body 324 with threads 326 and a distal end 328. The screw 320 is associated with a resilient means, such as a spring 330 or elastomeric member, resting on the screw head 322. The screw 320 bearing the spring 320 is received by bore 332 in second member 294, bore 334 in first member 292, and bore 336 and reduced-diameter bore 338 in second member 294, in a pin and slot arrangement, such that the spring 330 is retained between the screw head 322 and an annular shoulder 340 defined at the transition between bore 336 and reduced-diameter bore 338. The distal end 328 of the screw 320 extends beyond second member 294 and is received by axial bore 308 in interior rod 307. The screw 320 thus mounts the first razor head member 16 and the second first razor head member 18 to the handle portion 272.

Similar to apparatus 10, first razor head member 292 can be placed in a plurality of positions relative to the second razor head member 294, as dictated by the meshing of internal radial gear teeth 340 of half ring 287 and gear teeth 342 of first razor head member 292. The positioning thus also depends on the pitch of gear 342 on the first razor head member 292, internal radial gear teeth 344 on ring portion 286, and gears 346 on the second razor head member 294. In operation, starting in a first position the gear teeth 346 of semi-circular geared portion of the second ring razor head member 294 engage the radial gear teeth 344 of the ring portion 286, and gear teeth 346 of the semi-circular geared portion of the second ring razor head member 294 engage the internal radial gears 340 of the half ring 287. The spring 330 biases the handle portion 272 against the first razor head member 292 and the second razor head member 294, and the first razor head member 292 and the second razor head member 294 are locked in place, and can not rotate about the screw 320.

In order to move the apparatus 270 into a second position, a force is applied to the actuating rod 305 to cause the actuating rod 305 to travel towards opposing arms 311, 311' of the interior rod 307, and the pair of opposing detents 317, 317' travel within opposing channels 318, 318' in handle 278, compressing the spring 319, until coming to a stop. The applied force is thus transmitted to the interior rod 307 and is sufficient to cause the gear teeth 340 of the half ring 287 to disengage the gear teeth 342 of the first razor head member 292, while maintaining the engagement between the teeth 346 of semi-circular geared portion of the second razor head member 294 and the radial gear teeth 344 of the ring portion 286. Accordingly, the first razor head member 292 is now able to rotate about the screw 320, while the second razor head member 294 and the frustoconical portion 284 stay in a locked arrangement. When the first razor head member 292 is in the desired second position, the force is removed and the spring 320 biases the gear teeth 340 of the half ring 287 against gear teeth 342 of the first razor head member 292, to lock the first razor head member 292 and the second razor head member 294, in the second position.

Figure 18A:
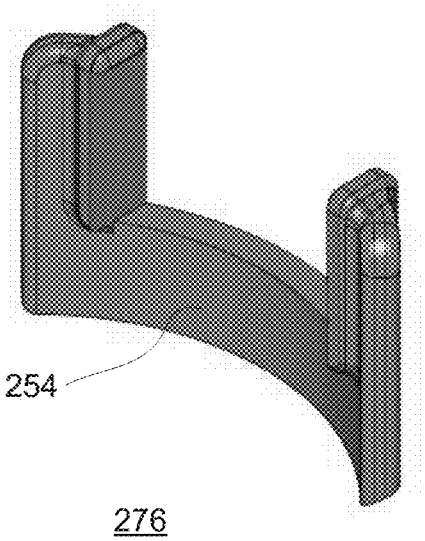
FIGS. 18*a* to 18*d* show various cartridges for uses with a razor assembly.
Figure 18B:
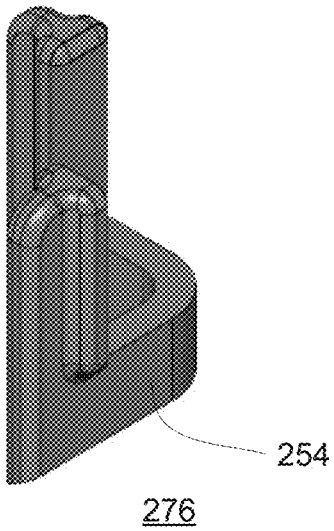

Other disposable razor configurations for mounting on first razor head member 292 and the second razor head member 294, may be employed to effect a desired shaving profile. For example, in another embodiment, disposable cartridge 276 comprises an arcuate body 254, and the degree of curvature depends on the desired shaving profile. FIGS. 18*a* and 18*b* show exemplary curved disposable cartridges 270. Accordingly, the blade members 260 have a corresponding arcuate profile.

Figure 18C:
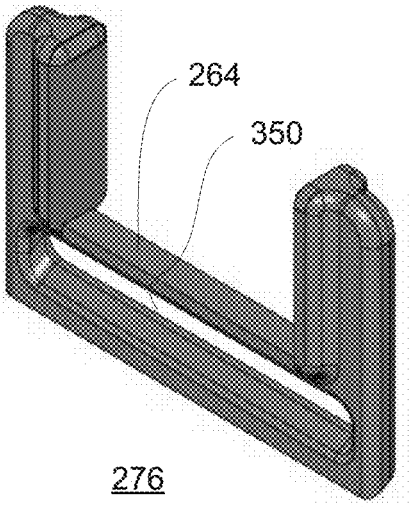

In another embodiment, disposable cartridge 276 comprises a U-shape body 254, with an elongate aperture 350 within midsection 264. The aperture 248 enhances visibility of the shaving site, as well as impedes accumulation of shaving products and hair on body 237, as shown in FIG. 18*c*.

Figure 18D:
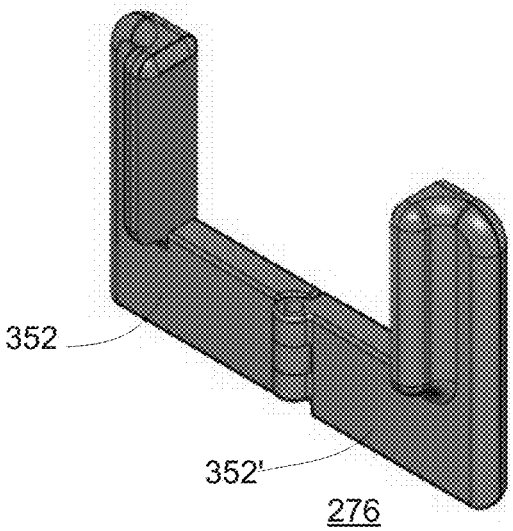

In another embodiment, disposable cartridge 276 comprises a U-shape body 254, formed with a pair of hinged portions 352, 352', as shown in FIG. 18*d*. Accordingly, hinged portions 352, 352' articulate relative to place the disposable cartridge 276 into a plurality of lockable, incremental positions, chosen in accordance with a desired shaving style or profile.

Figure 19:
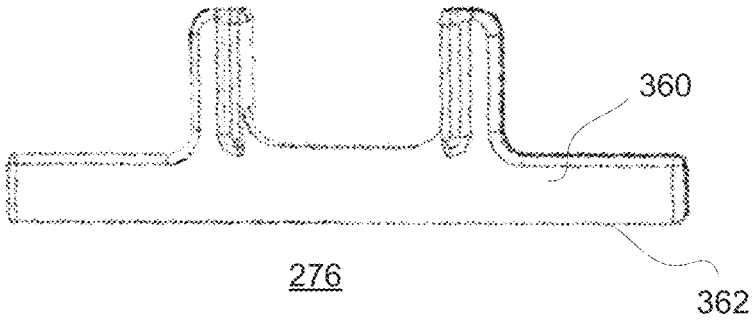
FIG. 19 shows a flexible cartridge.

In yet another embodiment, a blade cartridge 276 comprises a flexible body 360, with a flexible blade 362, mountable on first razor head member 292 and the second razor head member 294, as shown in FIG. 19. Accordingly, both the cartridge and the flexible blade 362 are resilient, flexible or bendable and are capable of being place in a plurality of positions as described above. The flexible body 360 with flexible blade 362 may thus be placed into a plurality of positions by articulating the first razor head member 292 and the second razor head member 294 relative to each other to suit the user's desired profile, such as a lineup. In one example, flexible body 360 is made from neoprene and may be used in conjunction with a marking liquid, with or without a neoprene blade 362 to provide a guide for shaving. Once the position is set, an edge of the flexible body 360 or flexible blade 362 is dipped in a coloured solution, and caused to impart a visible imprint or outline at a location for shaving, such that the visible imprint or outline acts as a guide to effect the desired profile.

In yet another embodiment, the edges of the blade members 240, 260, and 362 are coloured such that the point of contact of the blade edge with the surface having hair is more visible to the user. The increased visibility of the blade edge against the skin allows the user to better develop outline profiles, which results in better results.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as critical, required, or essential features or elements of any or all the claims. As used herein, the terms "comprises," "comprising," or any other variations thereof, are intended to cover a non-exclusive inclusion, such that a process, method, article, or apparatus that comprises a list of elements does not include only those elements but may include other elements not expressly listed or inherent to such process, method, article, or apparatus. Further, no element described herein is required for the practice of the invention unless expressly described as "essential" or "critical."

The preceding detailed description of exemplary embodiments of the invention makes reference to the accompanying drawings, which show the exemplary embodiment by way of illustration. While these exemplary embodiments are described in sufficient detail to enable those skilled in the art to practice the invention, it should be understood that other embodiments may be realized and that logical and mechanical changes may be made without departing from the spirit and scope of the invention. For example, the steps recited in any of the method or process claims may be executed in any order and are not limited to the order presented. Further, the present invention may be practiced using one or more servers, as necessary. Thus, the preceding detailed description is presented for purposes of illustration only and not of limitation, and the scope of the invention is defined by the preceding description, and with respect to the attached claims.

The invention claimed is:

1. A handle for profiling facial hair comprising:

a ring portion with a first set of internal radial gears and a second set of internal radial gears;

a first head member comprising first head member gears and a second head member comprising second head member gears, wherein the first head member gears releasably engage the second set of internal radial gears and the second head member gears releasably engage the first set of internal radial gears, and whereby the first head member and the second head member are pivotable about each other and are rotatably coupled to the handle; and a cartridge having a flexible body received by the first head member and the second head member.

2. The handle of claim 1, wherein the first head member is pivoted to at least one position relative to the second head member.

3. The handle of claim 2, further comprising a lock for maintaining the first head member and the second head member in the at least one position.

4. The handle of claim 3, wherein the cartridge is removably attached to the first head member and the second head member.

5. The handle of claim 4, wherein the cartridge is transparent to enhance visibility of the flexible body on a shaving site.

6. The handle claim 5, wherein the cartridge comprises a flexible blade member.

7. The handle of claim 6, wherein the flexible blade member is colored to enhance visibility of the flexible blade member on tad the shaving site.

8. The handle of claim 6, wherein the flexible blade member is composed of a polymeric material.

9. A method of use of the handle of claim 6, wherein a colored fluid on the flexible blade member is used to impart a visible imprint or an outline at the shaving site, such that the visible imprint or the outline guides a user to effect a desired profile.

10. A handle for profiling facial hair comprising:

a ring portion with a first set of internal radial gears and a second set of internal radial gears;

a first head member comprising frist head member gears and a second head member comprising second head member gears, wherein the first head member gears releasably en gage the second set of internal radial rears and the second head member gears releasably engage the first set of internal radial nears, and whereby the first head member and the second head member are pivotable about each other and are rotatably coupled to the handle; and a flexible blade member coupled to the first head member and the second head member for providing a profile guide at a shaving site.

11. The handle of claim 10, wherein the first head member is placed in various positions relative to the second head member.

12. The handle of claim 11, further comprising a lock for maintaining the first head member and the second head member in at least one position.

13. The handle of claim 12, wherein the flexible blade member is transparent and an edge of the flexible blade member is colored to enhance visibility of the flexible blade member on the shaving site.

14. The handle of claim 13, wherein the flexible blade member is composed of an elastomeric material.

15. A method of use of the handle of claim 14 wherein an edge of the flexible blade member comprises a colored fluid to impart a visible imprint or an outline at the shaving site, such that the visible imprint or the outline guides a user to effect a desired profile.

16. A handle for profiling facial hair comprising:

A ring portion with a first set of internal radial gears and a second set of internal radial gears;

a first head member comprising first head member gears and a second head member comprising second head member gears, wherein the first head member gears releasably engaged the second set of internal radial gears and the second head member gears releasably engage the first set of internal radial gears, and whereby the first head member and the second head member are pivotable about each other and are rotatably coupled to the handle; a flexible blade member coupled to the first head member and the razor head member by a cartridge;

a lock for maintaining the first head member and the second head member in at least one position; and wherein with the cartridge and flexible blade member on the first head member and the second head member, the first head member and the second head member are locked in the at least one position and the flexible blade member is placed on a shaving site as a beard profile guide.

17. The handle of claim 16, wherein the flexible blade member is transparent and an edge of the flexible blade member is colored to enhance visibility of the flexible blade member on the shaving site.

* * * * *